US011712814B2

(12) United States Patent
Zucker

(10) Patent No.: US 11,712,814 B2
(45) Date of Patent: Aug. 1, 2023

(54) RAZOR CARTRIDGE

(71) Applicant: Personal Care Marketing and Research, Inc., Marina Del Rey, CA (US)

(72) Inventor: Shlomo Zucker, Beverly Hills, CA (US)

(73) Assignee: Dollar Shave Club, Inc., Marina del Rey, CA (US)

( * ) Notice: Subject to any disclaimer, the term of this patent is extended or adjusted under 35 U.S.C. 154(b) by 57 days.

(21) Appl. No.: 17/401,199

(22) Filed: Aug. 12, 2021

(65) Prior Publication Data

US 2021/0370535 A1 Dec. 2, 2021

Related U.S. Application Data

(63) Continuation of application No. 16/134,566, filed on Sep. 18, 2018, now Pat. No. 11,117,280, which is a continuation of application No. PCT/US2017/023078, filed on Mar. 17, 2017.

(60) Provisional application No. 62/310,099, filed on Mar. 18, 2016.

(51) Int. Cl.

| | |
|---|---|
| ***B26B 21/22*** | (2006.01) |
| ***B26B 21/56*** | (2006.01) |
| ***B26B 21/40*** | (2006.01) |
| ***B26B 21/54*** | (2006.01) |
| *B26B 21/44* | (2006.01) |

(52) U.S. Cl.

CPC ..... *B26B 21/565* (2013.01); *B26B 21/22* (2013.01); *B26B 21/4012* (2013.01); *B26B 21/4018* (2013.01); *B26B 21/4031* (2013.01); *B26B 21/54* (2013.01); *B26B 21/56* (2013.01); *B26B 21/4037* (2013.01); *B26B 21/443* (2013.01)

(58) Field of Classification Search

CPC ... B26B 21/565; B26B 21/22; B26B 21/4012; B26B 21/4018; B26B 21/4031; B26B 21/54; B26B 21/56; B26B 211/4037

See application file for complete search history.

(56) References Cited

U.S. PATENT DOCUMENTS

| | | | |
|---|---|---|---|
| 2,138,353 | A | 11/1938 | Victor |
| 3,660,893 | A | 5/1972 | Welsh |
| 3,934,339 | A | 1/1976 | Dawidowicz et al. |
| 3,938,247 | A | 2/1976 | Carbonell et al. |

(Continued)

FOREIGN PATENT DOCUMENTS

| | | | |
|---|---|---|---|
| CN | 1404433 | A | 3/2003 |
| CN | 1917988 | A | 2/2007 |

(Continued)

*Primary Examiner* — Evan H Macfarlane
*Assistant Examiner* — Liang Dong
(74) *Attorney, Agent, or Firm* — DLA Piper LLP (US)

(57) ABSTRACT

Disclosed here are shaving razor systems and methods including razor cartridges with a unitary frame having a length and width, a topside and an underside, wherein the unitary frame includes angled joints or bends connecting at least three guards running lengthwise on the unitary frame, the guards separated by at least three gaps in the frame, and at least three blades, affixed to the underside of the guards of the unitary frame, wherein the at least three blades include edges, and wherein the blade edges extend into the gaps in the frame when affixed to the underside of the guards of the unitary frame.

7 Claims, 16 Drawing Sheets

(56) References Cited

U.S. PATENT DOCUMENTS

| | | | |
|---|---|---|---|
| 3,964,159 | A | 6/1976 | Ferraro |
| 4,016,648 | A | 4/1977 | Chen et al. |
| 4,026,016 | A | 5/1977 | Nissen |
| 4,057,896 | A | 11/1977 | Trotta |
| 4,063,354 | A | 12/1977 | Oldroyd et al. |
| 4,063,357 | A | 12/1977 | Francis |
| 4,083,104 | A | 4/1978 | Nissen et al. |
| 4,084,316 | A | 4/1978 | Francis |
| 4,094,063 | A | 6/1978 | Trotta |
| 4,146,958 | A | 4/1979 | Chen et al. |
| 4,168,571 | A | 9/1979 | Francis |
| 4,180,907 | A | 1/1980 | Iten |
| 4,198,746 | A | 4/1980 | Trotta |
| 4,200,976 | A | 5/1980 | Gooding |
| 4,247,982 | A | 2/1981 | Booth et al. |
| 4,253,235 | A | 3/1981 | Jacobson |
| 4,253,236 | A | 3/1981 | Jacobson |
| 4,253,237 | A | 3/1981 | Jacobson |
| 4,257,160 | A | 3/1981 | Murai |
| 4,258,471 | A | 3/1981 | Jacobson |
| 4,265,015 | A | 5/1981 | Asano |
| 4,266,340 | A | 5/1981 | Bowman |
| 4,270,268 | A | 6/1981 | Jacobson |
| 4,272,885 | A | 6/1981 | Ferraro |
| 4,275,498 | A | 6/1981 | Ciaffone |
| 4,281,454 | A | 8/1981 | Trotta |
| 4,281,456 | A | 8/1981 | Douglass et al. |
| 4,282,650 | A | 8/1981 | Trotta |
| 4,282,651 | A | 8/1981 | Trotta |
| 4,283,850 | A | 8/1981 | Douglass et al. |
| 4,288,920 | A | 9/1981 | Douglass et al. |
| 4,300,285 | A | 11/1981 | Endo |
| 4,302,876 | A | 12/1981 | Emmett |
| 4,308,663 | A | 1/1982 | Ciaffone |
| 4,309,821 | A | 1/1982 | Terry et al. |
| 4,324,041 | A | 4/1982 | Trotta |
| 4,335,508 | A | 6/1982 | Francis et al. |
| 4,337,575 | A | 7/1982 | Trotta |
| 4,345,374 | A | 8/1982 | Jacobson |
| 4,354,312 | A | 10/1982 | Trotta |
| 4,378,633 | A | 4/1983 | Jacobson |
| 4,378,634 | A | 4/1983 | Jacobson |
| 4,389,773 | A | 6/1983 | Nissen et al. |
| 4,392,303 | A | 7/1983 | Ciaffone |
| 4,395,822 | A | 8/1983 | Ciaffone |
| 4,403,412 | A | 9/1983 | Trotta |
| 4,403,413 | A | 9/1983 | Trotta |
| 4,403,414 | A | 9/1983 | Kiraly et al. |
| 4,407,067 | A | 10/1983 | Trotta |
| 4,411,065 | A | 10/1983 | Trotta |
| 4,413,411 | A | 11/1983 | Trotta |
| 4,422,237 | A | 12/1983 | Trotta |
| 4,428,116 | A | 1/1984 | Chen et al. |
| 4,442,598 | A | 4/1984 | Jacobson |
| 4,443,940 | A | 4/1984 | Francis et al. |
| 4,446,619 | A | 5/1984 | Jacobson |
| 4,486,952 | A | 12/1984 | Trotta |
| 4,488,357 | A | 12/1984 | Jacobson |
| 4,492,024 | A | 1/1985 | Jacobson |
| 4,492,025 | A | 1/1985 | Jacobson |
| 4,498,235 | A | 2/1985 | Jacobson |
| 4,514,904 | A | 5/1985 | Bond |
| 4,551,916 | A | 11/1985 | Jacobson |
| 4,573,266 | A | 3/1986 | Jacobson |
| 4,574,476 | A | 3/1986 | Ortiz |
| 4,586,255 | A | 5/1986 | Jacobson |
| 4,587,729 | A | 5/1986 | Jacobson |
| 4,599,793 | A | 7/1986 | Iten |
| 4,621,424 | A | 11/1986 | Jacobson |
| 4,739,553 | A | 4/1988 | Lazarchik |
| 4,785,534 | A | 11/1988 | Lazarchik |
| 4,797,998 | A | 1/1989 | Motta |
| 4,868,983 | A | 9/1989 | Francis |
| 4,901,437 | A | 2/1990 | Iten |
| 4,932,122 | A | 6/1990 | Shurland et al. |
| 4,932,123 | A | 6/1990 | Francis |
| 5,016,352 | A | 5/1991 | Metcalf |
| 5,038,472 | A | 8/1991 | Iderosa |
| 5,044,077 | A | 9/1991 | Ferraro et al. |
| 5,056,222 | A | 10/1991 | Miller et al. |
| 5,067,238 | A | 11/1991 | Miller et al. |
| 5,092,042 | A | 3/1992 | Miller et al. |
| 5,107,590 | A | 4/1992 | Burout et al. |
| 5,134,775 | A | 8/1992 | Althaus et al. |
| 5,141,694 | A | 8/1992 | Butlin et al. |
| 5,157,834 | A | 10/1992 | Chen et al. |
| 5,182,858 | A | 2/1993 | Chen |
| 5,191,712 | A | 3/1993 | Crook et al. |
| 5,224,267 | A | 7/1993 | Simms et al. |
| 5,236,439 | A | 8/1993 | Kozikowski |
| 5,249,361 | A | 10/1993 | Apprille, Jr. et al. |
| D346,042 | S | 4/1994 | Chu |
| 5,313,705 | A | 5/1994 | Rivers et al. |
| 5,313,706 | A | 5/1994 | Motta et al. |
| 5,318,429 | A | 6/1994 | Butlin et al. |
| 5,331,740 | A | 7/1994 | Carson et al. |
| 5,333,383 | A | 8/1994 | Ferraro |
| 5,359,774 | A | 11/1994 | Althaus |
| 5,365,665 | A | 11/1994 | Coffin |
| 5,373,638 | A | 12/1994 | Coffin |
| 5,377,409 | A | 1/1995 | Chen |
| 5,410,812 | A | 5/1995 | Althaus |
| 5,416,974 | A | 5/1995 | Wain |
| 5,426,851 | A | 6/1995 | Gilder et al. |
| 5,430,939 | A | 7/1995 | Johnston |
| 5,456,009 | A | 10/1995 | Wexler |
| 5,526,567 | A | 6/1996 | Carson et al. |
| 5,533,263 | A | 7/1996 | Gilder |
| 5,546,660 | A | 8/1996 | Burout et al. |
| 5,551,153 | A | 9/1996 | Simms |
| 5,557,851 | A | 9/1996 | Ortiz |
| 5,630,275 | A | 5/1997 | Wexler |
| 5,661,907 | A | 9/1997 | Apprille, Jr. |
| 5,669,139 | A | 9/1997 | Oldroyd et al. |
| 5,711,076 | A | 1/1998 | Yin et al. |
| 5,761,814 | A | 6/1998 | Anderson et al. |
| 5,784,790 | A | 7/1998 | Carson et al. |
| 5,787,586 | A | 8/1998 | Apprille, Jr. et al. |
| 5,794,343 | A | 8/1998 | Lee et al. |
| 5,794,354 | A | 8/1998 | Gilder |
| 5,802,721 | A | 9/1998 | Wain et al. |
| 5,813,119 | A | 9/1998 | Ferraro et al. |
| 5,813,293 | A | 9/1998 | Apprille, Jr. et al. |
| 5,822,869 | A | 10/1998 | Metcalf et al. |
| 5,823,082 | A | 10/1998 | Wilson et al. |
| D402,084 | S | 12/1998 | Chen et al. |
| 5,855,071 | A | 1/1999 | Apprille, Jr. et al. |
| 5,903,979 | A | 5/1999 | Oldroyd |
| 5,915,791 | A | 6/1999 | Yin et al. |
| 5,918,369 | A | 7/1999 | Apprille, Jr. et al. |
| 5,953,819 | A | 9/1999 | Simms et al. |
| 5,953,824 | A | 9/1999 | Ferraro et al. |
| 5,953,825 | A | 9/1999 | Christman et al. |
| 5,956,851 | A | 9/1999 | Apprille, Jr. et al. |
| D415,315 | S | 10/1999 | Swanson et al. |
| 6,009,624 | A | 1/2000 | Apprille, Jr. et al. |
| 6,026,577 | A | 2/2000 | Ferraro |
| 6,029,354 | A | 2/2000 | Apprille, Jr. et al. |
| 6,035,537 | A | 3/2000 | Apprille, Jr. et al. |
| D422,751 | S | 4/2000 | Gray |
| 6,044,542 | A | 4/2000 | Apprille, Jr. et al. |
| D424,744 | S | 5/2000 | Coffin et al. |
| 6,112,412 | A | 9/2000 | Richard |
| 6,115,924 | A | 9/2000 | Oldroyd |
| 6,122,826 | A | 9/2000 | Coffin et al. |
| 6,138,361 | A | 10/2000 | Richard et al. |
| 6,165,456 | A | 12/2000 | Bamet et al. |
| 6,173,498 | B1 | 1/2001 | Warrick et al. |
| 6,182,365 | B1 | 2/2001 | Tseng et al. |
| 6,182,366 | B1 | 2/2001 | Richard |
| 6,212,777 | B1 | 4/2001 | Gilder et al. |
| 6,216,349 | B1 | 4/2001 | Gilder et al. |
| 6,216,561 | B1 | 4/2001 | Dischler |
| 6,233,829 | B1 | 5/2001 | Oglesby et al. |

(56) References Cited

U.S. PATENT DOCUMENTS 6,266,884 B1 7/2001 Prochaska
6,276,062 B1 8/2001 Prochaska
6,295,734 B1 10/2001 Gilder et al.
6,298,557 B1 10/2001 Gilder
6,305,084 B1 * 10/2001 Zucker ..... B26B 21/22 30/47
6,311,400 B1 11/2001 Hawes et al.
6,317,990 B1 11/2001 Ferraro
6,381,857 B1 5/2002 Oldroyd
6,393,706 B1 5/2002 Ferraro
6,430,818 B1 8/2002 Wonderley
6,434,839 B1 8/2002 Lee et al.
6,502,318 B1 1/2003 Gilder
6,516,518 B1 2/2003 Garraway et al.
6,550,141 B1 4/2003 Rivers et al.
6,560,881 B2 5/2003 Coffin
6,584,696 B2 7/2003 Ferraro
6,601,303 B2 8/2003 Gilder et al.
6,612,040 B2 9/2003 Gilder
6,615,498 B1 9/2003 King et al.
6,651,342 B1 11/2003 Walker, Jr.
D484,275 S 12/2003 Prochaska
6,655,029 B2 12/2003 Saito
6,675,479 B1 1/2004 Walker et al.
6,769,180 B2 8/2004 Coffin
6,772,523 B1 8/2004 Richard et al.
6,792,682 B2 9/2004 Follo et al.
6,807,739 B2 10/2004 Follo
D499,843 S 12/2004 Nakasuka
6,839,968 B2 1/2005 Brown et al.
6,854,188 B1 2/2005 Wonderley
6,880,253 B1 4/2005 Gyllerstrom
6,935,032 B2 8/2005 Follo
6,941,659 B2 9/2005 Gilder
D514,253 S 1/2006 Gray
6,990,740 B2 1/2006 Follo et al.
D516,243 S 2/2006 Nakasuka
7,043,840 B2 5/2006 Walker et al.
7,047,646 B2 5/2006 Coffin
D524,986 S 7/2006 Prudden, Jr.
D526,089 S 8/2006 Fischer et al.
7,086,160 B2 8/2006 Coffin et al.
7,111,401 B2 9/2006 Richard
7,137,205 B2 11/2006 Royle
7,140,116 B2 11/2006 Coffin
D533,684 S 12/2006 Gray et al.
7,152,512 B1 12/2006 Prochaska
D535,784 S 1/2007 Wonderley et al.
7,168,173 B2 1/2007 Worrick, III
7,191,523 B2 3/2007 Miyazaki et al.
7,197,825 B2 4/2007 Walker et al.
7,200,937 B2 4/2007 Richard et al.
7,200,938 B2 4/2007 Lembke
7,200,942 B2 4/2007 Richard
7,210,229 B2 5/2007 Coffin
D547,494 S 7/2007 Watson et al.
7,266,895 B2 9/2007 Pennell et al.
7,272,991 B2 9/2007 Aviza et al.
D556,378 S 11/2007 Watson et al.
D560,034 S 1/2008 Fischer et al.
D563,043 S 2/2008 Ramm
D563,044 S 2/2008 Ramm
7,331,107 B2 2/2008 Follo et al.
D575,454 S 8/2008 Keene et al.
7,448,135 B2 11/2008 Zhuk et al.
7,461,458 B2 12/2008 Peyser et al.
7,469,477 B2 12/2008 Coffin
7,475,483 B2 1/2009 Peyser et al.
D588,309 S 3/2009 Wonderley et al.
D588,744 S 3/2009 Fischer et al.
D588,745 S 3/2009 Fischer et al.
7,526,869 B2 5/2009 Blatter et al.
7,540,087 B2 6/2009 Rawle
7,540,088 B2 6/2009 Takeshita
7,574,809 B2 8/2009 Follo et al.
7,578,062 B2 8/2009 Blackburn
D601,753 S 10/2009 Cataudella et al.
7,607,230 B2 10/2009 Aviza et al.
D604,904 S 11/2009 Watson
7,617,607 B2 11/2009 Pennell et al.
7,621,203 B2 11/2009 Aviza
7,669,335 B2 3/2010 Walker et al.
7,676,929 B2 3/2010 Lembke et al.
7,681,314 B2 3/2010 Follo
7,685,720 B2 3/2010 Efthimiadis et al.
7,690,122 B2 4/2010 Worrick et al.
D617,946 S 6/2010 Lukan et al.
D617,947 S 6/2010 Lukan et al.
D617,948 S 6/2010 Lukan et al.
D617,949 S 6/2010 Lukan et al.
7,739,797 B2 6/2010 Rawle
7,765,700 B2 8/2010 Aviza et al.
7,770,294 B2 8/2010 Bruno et al.
7,802,368 B2 9/2010 Coffin et al.
D625,049 S 10/2010 Bridges et al.
D625,883 S 10/2010 Wonderley
7,810,240 B2 10/2010 Lee et al.
7,811,553 B2 10/2010 O'Grady et al.
D629,564 S 12/2010 Jung
D630,378 S 1/2011 Jung
D630,797 S 1/2011 Witkus
D631,198 S 1/2011 Adams et al.
D633,253 S 2/2011 Wonderley et al.
D633,254 S 2/2011 Witkus
7,877,879 B2 2/2011 Nakasuka
D634,474 S 3/2011 Wilby
7,895,754 B2 3/2011 Blackburn
7,913,393 B2 3/2011 Royle et al.
D635,717 S 4/2011 Furtek
D636,532 S 4/2011 Jessemey et al.
D639,507 S 6/2011 Furtek
D640,415 S 6/2011 Wonderley et al.
7,966,731 B2 6/2011 Walker et al.
D643,976 S 8/2011 Wonderley et al.
D643,977 S 8/2011 Wonderley et al.
7,992,304 B2 8/2011 Nakasuka
8,033,023 B2 10/2011 Johnson et al.
D648,075 S 11/2011 Wonderley et al.
D648,076 S 11/2011 Jessemey et al.
8,046,920 B2 11/2011 Nakasuka
D653,395 S 1/2012 Adams et al.
8,096,054 B2 1/2012 Denkert et al.
8,104,179 B2 1/2012 Nakasuka
8,104,184 B2 1/2012 Walker
8,117,753 B2 2/2012 Gilder et al.
8,146,255 B2 4/2012 Denkert et al.
8,151,472 B2 4/2012 Dimitris et al.
D658,809 S 5/2012 Jessemey et al.
8,186,062 B2 5/2012 Fischer et al.
D661,425 S 6/2012 Cataudella et al.
D661,426 S 6/2012 Wain et al.
D662,661 S 6/2012 Corbeil et al.
8,205,343 B2 6/2012 Winter et al.
8,205,344 B2 6/2012 Stevens
8,209,867 B2 7/2012 Clarke
8,225,510 B2 7/2012 Peterson et al.
D665,130 S 8/2012 Wain et al.
8,234,789 B2 8/2012 Wens et al.
8,281,497 B2 10/2012 Takeba
8,286,354 B2 10/2012 Walker et al.
8,336,212 B2 12/2012 Bozikis et al.
8,359,751 B2 1/2013 Efthimiadis et al.
8,359,752 B2 1/2013 Bridges
8,381,406 B2 2/2013 Miyazaki
8,413,334 B2 4/2013 Walker et al.
8,429,826 B2 4/2013 Clarke
8,438,736 B2 5/2013 Keene et al.
8,448,339 B2 5/2013 Walker et al.
8,474,144 B2 7/2013 Royle
8,499,459 B2 8/2013 Efthimiadis et al.
8,533,959 B2 9/2013 Davis
8,533,961 B2 9/2013 Nicoll et al.
8,544,177 B2 10/2013 Rawle et al.
8,555,900 B2 10/2013 Nicoll et al.

(56) References Cited

U.S. PATENT DOCUMENTS 8,567,068 B2 10/2013 Luxton
8,590,162 B2 11/2013 Park et al.
D699,892 S 2/2014 Wonderley
8,640,342 B2 2/2014 Murdiga
D701,646 S 3/2014 Jobdevairakkam
8,661,689 B2 3/2014 Fathallah et al.
8,707,562 B2 4/2014 Coffin
8,726,518 B2 5/2014 Bruno
8,732,955 B2 5/2014 Howell et al.
8,732,965 B2 5/2014 Efthimiadis et al.
D707,885 S 6/2014 Cataudella et al.
8,745,882 B2 6/2014 Murdiga et al.
8,745,883 B2 6/2014 Murdiga et al.
8,769,825 B2 7/2014 Howell et al.
8,782,903 B2 7/2014 Clarke et al.
8,789,282 B2 7/2014 Wilson et al.
8,793,880 B2 8/2014 Taub et al.
8,931,176 B2 1/2015 Johnson et al.
8,931,380 B2 1/2015 Coffin
8,938,885 B2 1/2015 Stevens
8,978,258 B2 3/2015 Patel et al.
8,984,756 B2 3/2015 Worrick, III
8,991,058 B2 3/2015 Dimitris et al.
9,015,951 B2 4/2015 Howell et al.
D730,578 S 5/2015 Long et al.
9,032,627 B2 5/2015 Dimitris et al.
9,032,631 B2 5/2015 Christie et al.
D731,119 S 6/2015 Daniel et al.
D731,708 S 6/2015 Tucker et al.
9,073,226 B2 7/2015 Szczepanowski et al.
D737,511 S 8/2015 Lettenberger et al.
D737,513 S 8/2015 Lettenberger et al.
D741,008 S 10/2015 Bruno et al.
D741,009 S 10/2015 Bruno et al.
D741,546 S 10/2015 Witkus et al.
D744,165 S 11/2015 Tucker et al.
9,193,077 B2 11/2015 Worrick
9,193,078 B2 11/2015 Worrick, III
9,193,079 B2 11/2015 Howell et al.
D748,856 S 2/2016 Mahony et al.
D749,265 S 2/2016 Cataudella et al.
9,248,579 B2 2/2016 DePuydt et al.
9,259,846 B1 2/2016 Robertson
9,283,685 B2 3/2016 Griffin et al.
9,296,117 B2 3/2016 Fathallah et al.
9,321,182 B2 4/2016 Bridges et al.
9,327,414 B2 5/2016 Szczepanowski et al.
9,333,657 B2 5/2016 Westerhof et al.
9,364,961 B2 6/2016 Lelieveld
9,381,657 B2 7/2016 Ku et al.
D764,100 S 8/2016 Park et al.
D764,101 S 8/2016 Cataudella et al.
D766,505 S 9/2016 Coviello
9,434,079 B2 9/2016 Worrick, III
9,469,038 B2 10/2016 Iaccarino et al.
9,475,202 B2 10/2016 Griffin et al.
9,486,930 B2 11/2016 Provost et al.
9,498,892 B2 11/2016 Nakasuka et al.
D776,875 S 1/2017 Ren
D779,121 S 2/2017 Bruno et al.
9,579,809 B2 2/2017 Hawes
9,586,330 B2 3/2017 Ku et al.
9,623,575 B2 4/2017 Griffin et al.
9,630,331 B2 4/2017 Griffin et al.
9,643,327 B2 5/2017 Stevens et al.
9,656,401 B2 5/2017 Burrowes et al.
9,738,000 B2 8/2017 Ariyanayagam et al.
D811,658 S 2/2018 Cataudella et al.
D816,905 S 5/2018 Zucker
D816,906 S 5/2018 Zucker
D816,908 S 5/2018 Zucker
D816,909 S 5/2018 Zucker
D816,910 S 5/2018 Zucker
D816,912 S 5/2018 Zucker
D829,991 S 10/2018 Zucker
D844,898 S 4/2019 Knapp et al.
D850,722 S 6/2019 Knapp
10,350,773 B2 7/2019 Hill et al.
D867,661 S 11/2019 Ovvadias
10,538,007 B2 1/2020 Zucker
11,117,280 B2 9/2021 Zucker
2002/0000040 A1 1/2002 Gilder
2002/0184770 A1 12/2002 Peyser
2003/0046819 A1 3/2003 Ferraro et al.
2003/0079348 A1 5/2003 Follo
2003/0213130 A1 11/2003 Motta
2004/0103538 A1 6/2004 Dansreau et al.
2004/0128835 A1 7/2004 Coffin et al.
2004/0181949 A1 9/2004 Coffin et al.
2004/0181953 A1 9/2004 Follo et al.
2004/0181954 A1 9/2004 Follo et al.
2004/0216310 A1 11/2004 Santhagens et al.
2004/0231161 A1 11/2004 Coffin et al.
2004/0255467 A1 12/2004 Lembke et al.
2005/0015991 A1 1/2005 Follo et al.
2005/0039338 A1 2/2005 King et al.
2005/0241162 A1 11/2005 Nicolosi et al.
2006/0032056 A1 2/2006 Coffin et al.
2006/0070240 A1 4/2006 Fischer
2006/0242847 A1 11/2006 Dansreau et al.
2006/0254056 A1 11/2006 Coffin et al.
2006/0260131 A1 11/2006 Follo
2006/0272155 A1 12/2006 Mehta et al.
2006/0283025 A1 12/2006 Follo et al.
2007/0056167 A1 3/2007 Richard et al.
2007/0227009 A1 10/2007 Zhuk et al.
2007/0266565 A1 11/2007 Aviza et al.
2008/0034590 A1 2/2008 Prudden et al.
2008/0034593 A1 2/2008 Coffin
2008/0250647 A1 10/2008 Fischer et al.
2008/0256802 A1 10/2008 O'Connor et al.
2009/0071006 A1 3/2009 Bruno
2009/0071007 A1 3/2009 Bruno
2009/0083982 A1 4/2009 Forsdike
2009/0113716 A1 5/2009 Wain et al.
2009/0188112 A1 7/2009 Prochaska et al.
2009/0193659 A1 8/2009 Park et al.
2010/0043612 A1* 2/2010 Ichiyanagi ..... G01N 1/06 83/105
2010/0154220 A1 6/2010 Nakasuka
2010/0251555 A1 10/2010 Park et al.
2010/0313424 A1 12/2010 Johnson et al.
2011/0094108 A1 4/2011 Wain
2011/0119922 A1 5/2011 Ntavos et al.
2011/0232101 A1 9/2011 Park et al.
2012/0124840 A1 5/2012 Iaccarino et al.
2012/0151772 A1 6/2012 Moon et al.
2012/0279070 A1 11/2012 Seo
2013/0008029 A1 1/2013 Hill et al.
2013/0097869 A1 4/2013 Wang et al.
2013/0097872 A1 4/2013 Blatter
2013/0160305 A1 6/2013 Howell et al.
2013/0199346 A1 8/2013 Psimadas et al.
2013/0205595 A1 8/2013 Bykowski et al.
2013/0269190 A1 10/2013 Worrick, III
2013/0312265 A1 11/2013 Wilson et al.
2013/0326881 A1 12/2013 Blatter
2014/0000082 A1 1/2014 Xu
2014/0000114 A1 1/2014 Wester et al.
2014/0026424 A1 1/2014 Oglesby et al.
2014/0033551 A1 2/2014 Szczepanowski et al.
2014/0068953 A1 3/2014 Wonderley
2014/0083265 A1 3/2014 Provost et al.
2014/0090254 A1 4/2014 Wang et al.
2014/0096402 A1 4/2014 Nakasuka et al.
2014/0116211 A1 5/2014 Griffin et al.
2014/0165800 A1 6/2014 Griffin et al.
2014/0237830 A1 8/2014 Wilson et al.
2014/0245613 A1 9/2014 Good et al.
2014/0259675 A1 9/2014 Tucker et al.
2014/0259677 A1 9/2014 Coresh
2014/0283387 A1 9/2014 Bozikis et al.
2014/0331500 A1 11/2014 Ren
2014/0366381 A1 12/2014 Phipps et al.

(56) References Cited

U.S. PATENT DOCUMENTS

| | | | |
|---|---|---|---|
| 2015/0013169 | A1 | 1/2015 | Warrick |
| 2015/0040402 | A1 | 2/2015 | Carneiro et al. |
| 2015/0090085 | A1 | 4/2015 | Griffin et al. |
| 2015/0158190 | A1 | 6/2015 | Georgakis et al. |
| 2015/0190935 | A1 | 7/2015 | Griffin et al. |
| 2015/0197017 | A1 | 7/2015 | Lettenberger et al. |
| 2015/0217466 | A1 | 8/2015 | Leicht et al. |
| 2015/0239137 | A1 | 8/2015 | Davos et al. |
| 2015/0273708 | A1 | 10/2015 | Haba |
| 2015/0290819 | A1 | 10/2015 | Giannopoulos et al. |
| 2015/0314465 | A1 | 11/2015 | Giannopoulos et al. |
| 2015/0314466 | A1 | 11/2015 | Papadopoulos-Papageorgis et al. |
| 2016/0001454 | A1 | 1/2016 | Coresh |
| 2016/0001455 | A1 | 1/2016 | Swenson |
| 2016/0031101 | A1 | 2/2016 | Fulton |
| 2016/0082610 | A1 | 3/2016 | Bamundaga |
| 2016/0096280 | A1 | 4/2016 | Robertson |
| 2016/0129603 | A1 | 5/2016 | Antoniou et al. |
| 2016/0158948 | A1 | 6/2016 | Eagleton et al. |
| 2016/0158950 | A1 | 6/2016 | Griffin et al. |
| 2016/0236364 | A1 | 8/2016 | Varenberg et al. |
| 2016/0279817 | A1 | 9/2016 | Washington et al. |
| 2016/0297086 | A1 | 10/2016 | Efthimiadis et al. |
| 2017/0021513 | A1 | 1/2017 | Liberatore |
| 2017/0028577 | A1 | 2/2017 | Ntavos et al. |
| 2017/0151684 | A1 | 6/2017 | Bozikis et al. |
| 2017/0282389 | A1 | 10/2017 | Jolley et al. |
| 2018/0071931 | A1 | 3/2018 | Walker, Jr. et al. |
| 2018/0236677 | A1 | 8/2018 | Blatter |

FOREIGN PATENT DOCUMENTS

| | | | |
|---|---|---|---|
| CN | 103282166 | A | 9/2013 |
| CN | 104440969 | A | 3/2015 |
| CN | 105358295 | A | 2/2016 |
| DE | 60104558 | T2 | 7/2005 |
| DE | 10327739 | B4 | 6/2006 |
| DE | 102004061446 | A1 | 6/2006 |
| DE | 102010006807 | A1 | 9/2010 |
| DE | 202011107715 | U1 | 1/2012 |
| DE | 202013002343 | U1 | 4/2013 |
| DE | 202013003009 | U1 | 6/2013 |
| DE | 102013007224 | A1 | 9/2014 |
| DE | 102013007223 | A1 | 10/2014 |
| DE | 202014007575 | U1 | 10/2014 |
| DE | 102013213862 | A1 | 1/2015 |
| DE | 102015002458 | A1 | 9/2016 |
| EP | 1332026 | B1 | 7/2004 |
| EP | 1488894 | A1 | 12/2004 |
| EP | 1671761 | A1 | 6/2006 |
| EP | 1847360 | A1 | 10/2007 |
| EP | 2227360 | A1 | 9/2010 |
| EP | 2583800 | A1 | 4/2013 |
| EP | 2454056 | B1 | 3/2014 |
| EP | 3075498 | A1 | 10/2016 |
| ES | 2290591 | T3 | 2/2008 |
| ES | 2342497 | T3 | 7/2010 |
| ES | 1079011 | U | 4/2013 |
| GB | 1591095 | A | 6/1981 |
| GB | 2461054 | A | 12/2009 |
| GB | 2507971 | A | 5/2014 |
| GB | 2529999 | A | 3/2016 |
| IT | PI20110077 | A1 | 1/2013 |
| JP | H04361782 | A | 12/2012 |
| JP | 2013099467 | A | 5/2013 |
| NL | 2013416 | A | 10/2015 |
| RO | 118269 | B1 | 4/2003 |
| RU | 2433909 | C1 | 11/2011 |
| SE | 1230136 | C2 | 5/2014 |
| TR | 200402255 | T4 | 10/2004 |
| WO | WO0164403 | A1 | 9/2001 |
| WO | WO0232632 | A2 | 4/2002 |
| WO | WO0232633 | A2 | 4/2002 |
| WO | WO2005077614 | A1 | 8/2005 |
| WO | WO2009066218 | A1 | 5/2009 |
| WO | WO2009153598 | A1 | 12/2009 |
| WO | WO2010139618 | A1 | 12/2010 |
| WO | WO2012005839 | A2 | 1/2012 |
| WO | WO2012158141 | A1 | 11/2012 |
| WO | WO2012158142 | A1 | 11/2012 |
| WO | WO2014075844 | A1 | 5/2014 |
| WO | WO2014139655 | A2 | 9/2014 |
| WO | WO2015090385 | A1 | 6/2015 |
| WO | WO2016036238 | A2 | 3/2016 |
| WO | WO2016040549 | A1 | 3/2016 |
| WO | WO2016113553 | A1 | 7/2016 |

* cited by examiner

RAZOR CARTRIDGE

CROSS REFERENCE TO RELATED CASES

This application is a continuation of and claims priority to U.S. patent application Ser. No. 16/134,566 filed on Sep. 18, 2018, which is a continuation of and claims priority under 35 USC 120 to International Application No. PCT/US2017/023078 filed on Mar. 17, 2017, which claims priority to U.S. Provisional Application No. 62/310,099 filed on Mar. 18, 2016, the entireties of which are hereby incorporated by reference.

TECHNICAL FIELD

This application relates to the field of shaving razors, razor cartridges, razor blades, frames, lubrication, and other cartridge features.

BACKGROUND

Previously, shaving razors and razor cartridges suffered from inherent drawbacks based on their razor blade arrangements. Blades did not have separate guards in place, angles of the blades were not customized for different shaving characteristics and components of the cartridge led to less comfortable shaving experiences.

SUMMARY

Systems and methods here include improved razor blade cartridges. Embodiments include shaving systems, including a unitary frame having a length and width, a topside and an underside. In some embodiments, the unitary frame includes angled bends forming at least three lengthwise guards on the unitary frame, the guards separated by at least three gaps in the frame, and at least three blades, affixed lengthwise to the underside of the guards of the unitary frame. In some embodiments, the at least three blades include edges, and the blade edges extend into the gaps in the frame when affixed to the underside of the guards of the unitary frame.

Additionally or alternatively, in some embodiments the guards include back walls that support the blades. And in some examples, the frame is made of a single piece of metal. Additionally or alternatively, some embodiments include a cartridge housing surrounding the frame leaving the blades and guards exposed, the housing including a cap. And in some embodiments, the cartridge housing includes a front guard. Additionally or alternatively, in some embodiments the cartridge housing front guard includes a lubrication strip. And in some examples, the blades are affixed to the unitary frame by welds. Additionally or alternatively, in some embodiments the cartridge housing is made of a top and bottom which are configured to snap together and hold the frame. And in some examples, the front guard includes capillary tubes with lubrication soap. Additionally or alternatively, in some embodiments, the cap includes capillary tubes with lubrication soap. And in some examples, the number of guards is four and the number of blades is four. And in some examples, the number of guards is five and the number of blades is five. In some examples, the front guard is made of lubrication soap. And in some examples, the lubrication soap is slidably removable from the cartridge.

Additionally or alternatively, the blades are affixed to the underside of the unitary frame structure. Additionally or alternatively, the unitary frame is curved into a concave shape. Additionally or alternatively, the unitary frame is curved into a convex shape. In some examples, the blades in the cartridge head are perpendicular to the cartridge head itself. Additionally or alternatively, in some examples, the blades are canted from the perpendicular to impart a shearing force on a target hair. In such example embodiments, the canted blades may all be parallel to each other but not perpendicularly arranged in the cartridge head, rather, positioned in a canted arrangement. In some example embodiments, the canted blades may be grouped in parallel sets which are each canted in relation to one another with each set not perpendicularly arranged in the cartridge head, rather, positioned in a canted arrangement.

BRIEF DESCRIPTION OF THE DRAWINGS

For a better understanding of the embodiments described in this application, reference should be made to the Detailed Description below, in conjunction with the following drawings in which like reference numerals refer to corresponding parts throughout the figures.

DETAILED DESCRIPTION

Reference will now be made in detail to embodiments, examples of which are illustrated in the accompanying drawings. In the following detailed description, numerous specific details are set forth in order to provide a sufficient understanding of the subject matter presented herein. But it will be apparent to one of ordinary skill in the art that the subject matter may be practiced without these specific details. Moreover, the particular embodiments described herein are provided by way of example and should not be used to limit the scope of the invention to these particular embodiments.

Overview

Figure 1:
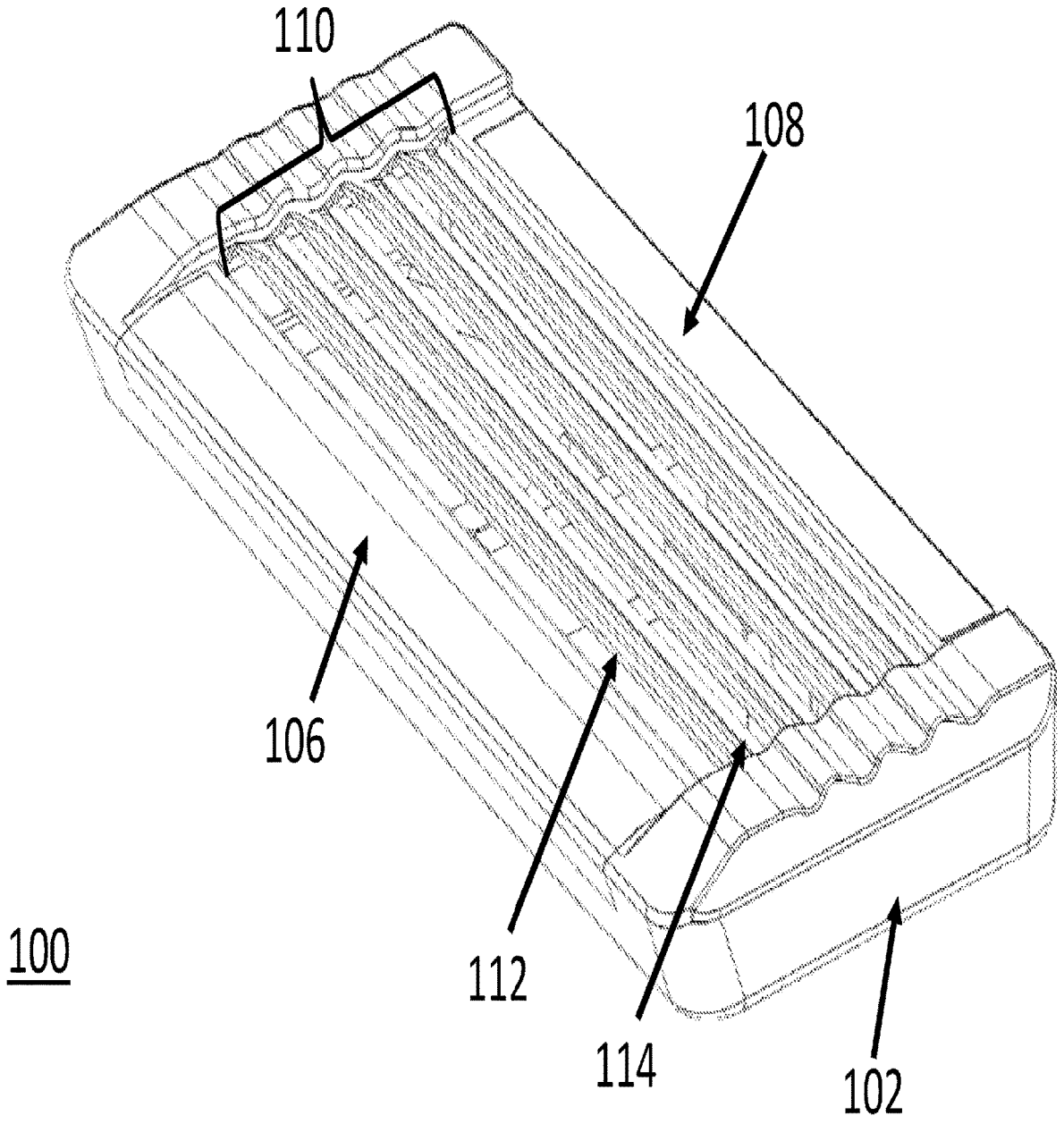
FIG. 1 is a perspective illustration of a razor cartridge according to some embodiments described here.

The razor cartridge embodiments described here include many of various features in any combination. Aspects of the razor cartridge include different embodiments of frame, blade arrangement, blade exposure, as well as guard aspects. Some example embodiments include an internal frame system which incorporates individual guards adjacent to portions to which blades may be affixed. FIG. 1 shows a perspective view of an example cartridge 100 according to some embodiments described here. The cartridge 100 example includes an overall housing 102 that has a front guard 106 and a cap 108. Either or both of the front guard 106 and the cap 108 may have lubrication features built in as described in more detail herein. The cartridge 100 example includes a unitary frame 110 element which include intermediary guards 114 spaced between portions where blades 112 may be mounted to run lengthwise down the cartridge 100. The example unitary frame 110 may be configured to support any number of blades including but not limited to one blade, two blades, three blades, four blades, five blades and six blades. The non-limiting example of FIG. 1 and throughout this description is four blades.

The geometry of the blades 112 in relation to the frame 110 and the guards 114 may include any of various arrangements as described here in order to affect the shaving experience of a user of the razor cartridge 100. A first general discussion of the frame 110 and blade 112 geometry is given below. Following this discussion are more detailed descriptions of various aspects of the razor cartridge 100 embodiments.

Geometry Examples

Three example geometry variables will be discussed that can be altered in the razor cartridge to affect a shave for a user. The three example geometry variables include gap, blade angle and blade exposure. The interplay of these variables among each other leads to trade-offs in the shaving experience. A less irritating arrangement may not be effective enough for users with tough beards. A very aggressive arrangement may be too harsh for users with sensitive skin. The embodiments described here include iterations of these three variables in multiple arrangements to achieve different shaving goals and delivering different shaving experiences to different users as well as tuning these variables to achieve the closest, most comfortable shave possible for as many users as possible.

Figure 2:
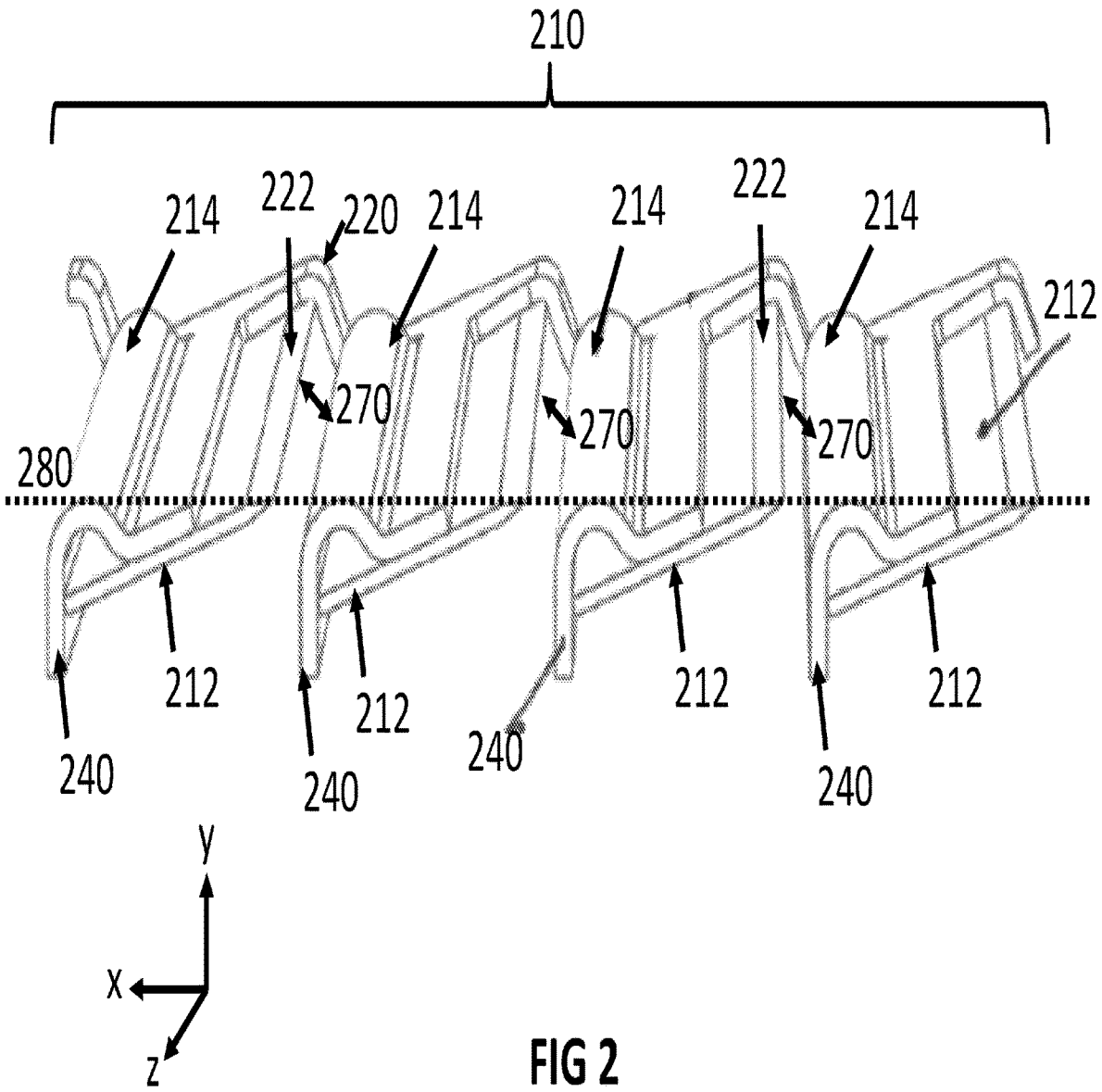
FIG. 2 is a cut away illustration of a razor frame and blades according to some embodiments described here.

FIG. 2 illustrates an example cut away view of a frame 210 assembly and four individual blades 212 which are shown affixed to the frame 210. To help describe the geometry of the configuration, x, y and z axis coordinates are shown in relation to the frame 210 is indicated.

The frame 210 includes intermediate guards 214 built into the frame itself which are shown both supporting each blade 212 by a back wall 240 and affixing to each blade 212 from above. The intermediate guards 214 also provide an intermediary guard fashioned as a ridge or hump that sticks out from the frame 210 in the y direction to engage the skin when the cartridge is applied in a shaving stroke. The frame 210 example also includes angled joints 220 which connect each blade 212 and guard 214 arrangement to the next and to the cartridge itself.

The first geometry variable of discussion is a gap. A gap 270 refers to the gap between a blade edge 212 and the next adjacent guard 212, whether that be the overall cartridge front guard or an intermediate guard in the frame. The larger the gap 270, the more hair is able to fit in the gap 270 and interact with the blade edge 212. The smaller the gap 270, the less hair is able to fit in the gap, but comfort may be improved. The gap may allow wash through of water and shaving material as well.

The second geometry variable of discussion is blade angle. The blade angle refers to the angle at which the blades 212 are positioned in the cartridge and/or frame 210 and interact with the user's skin in a shaving stroke. Referring to the angle of the blades 212 to the skin of a shaving user, between 0 (parallel to skin—and the neutral exposure line 280) to 17 degrees may be considered less aggressive. Between 17 degrees up to 45 degrees may be considered more aggressive. Some example embodiments may utilize blade angles between 12 and 30 degrees, where between 12 and 17 degrees may be less aggressive and between 17 and 30 degrees may be more aggressive.

Again, a more aggressive blade angle may lead to a closer cut of hair from the skin in a shaving stroke but it may be more irritating than a less aggressive blade angle for some users. Different users with different beards and skin may prefer different blade angles. Also, different areas of the body may require different blade angles.

In some embodiments, the blades 212 may be at slightly different angles from one another. For example, making the first few blades in the cartridge at a less aggressive angle because in a shaving stroke, they first interact with the skin and hairs, but the back of the frame having increasingly aggressive blade angles may increase the closeness of the shave. In some embodiments, a more aggressive blade angle is configured for the first blades and less aggressive angle is configured for the back blades. Any combination of blade angles in the frame could be configured and customized for different purposes.

The third geometry variable of discussion is blade exposure. The blade exposure refers to the exposure of the blade edges 222 in reference to a reference exposure line 280 drawn across the top of the overall cartridge. In other words, the exposure line 280 is drawn in reference to the frame 210, intermediate guards 214 as well as the overall cartridge cap 108 and guard 106 (from FIG. 1). Next, the blades 212 are affixed to the frame 210. The blade edges 222 that are affixed to the frame 210 to extend beyond the exposure line 280 result in a more exposed blade. The farther the blade edges 222 are affixed in the frame 210 set back from the exposure line 280, the less they are exposed.

The more the blade edges 222 are exposed, the more they may interact with the skin and hair in a shaving stroke and the more pressure may be applied to the skin and hair by the blades 212. The less the blade edges 222 are exposed, the less they may interact with the skin and hair in a shaving stroke. Again, as a trade-off, more exposed blades may result in a closer shave, but less exposed blades may provide a more comfortable shaving stroke.

In relation to the blade angles and blade exposure, some embodiments include angled joints or bends 220 in the frame 210. These angled joints or bends 220 connect the blade 212 and guard 214 portions to the next blade 212 and guard 214. Different angled joint 220 angles may affect the blade angle and blade exposure as described below.

It should be noted that the blade arrangements could be used in conjunction with and in addition to any of the other embodiments or features described in this disclosure. Therefore, a system could be built using any combination of the features described here.

Cartridge Examples

Figure 3:
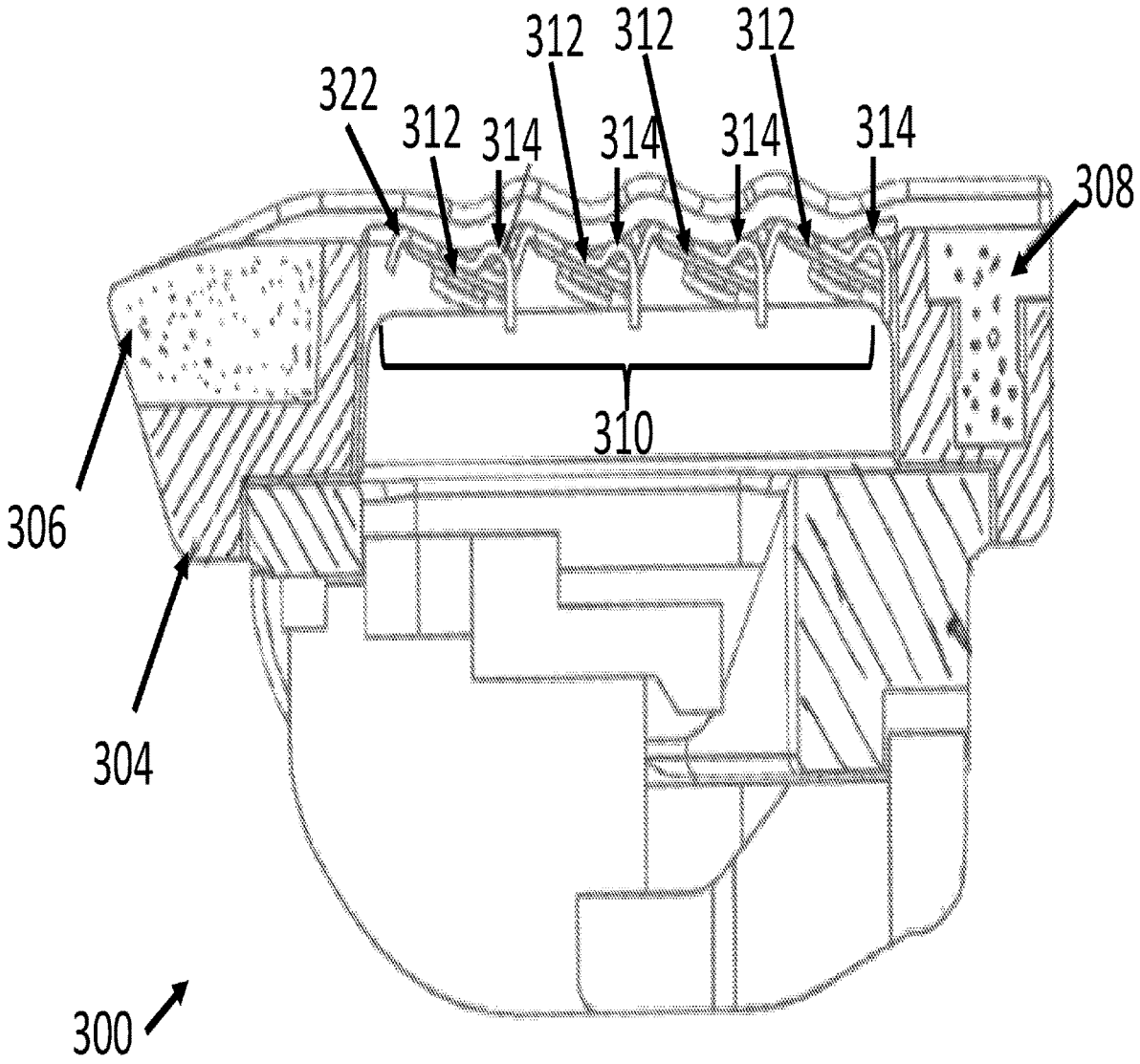
FIG. 3 is a cut away illustration of a razor cartridge according to some embodiments described here.

FIG. 3 shows a side angle cut away view of an example cartridge 300. The cartridge 300 example includes a cap 308, a housing 304, and a front guard 306. Some embodiments include a lubrication strip in the cap 308. The cartridge 300 also includes a frame 310 which is shown affixed to the housing 304 and supporting any number of blades 312.

The blades 312 are shown affixed to the underside of the frame 310 and the blade edges 322 are shown as exposed between the guards 314 of the frame 310. These exposed blade 312 edges 322 protrude through the frame 310 at specific angles in order to interact with a the skin and hair in a shaving stroke. The blades 312 could be affixed to the underside of the frame 310 in any number of ways including, but not limited to, welding, gluing, melding, snapping, riveting, strapping or other adhesive method.

The blades 312 could be made of any material. In some embodiments, the blades are made of metal such as aluminum, steel, stainless steel, iron, bronze, copper, tin or any amalgam of these or other metals. In some embodiments the blades 312 are made of plastics and/or composites. In some embodiments the blades 312 are made of a carbon fiber and/or ceramic. In some embodiments, the blades 312 may be honed to an edge and coated with any number of materials such as but not limited to chrome, polytetrafluoroethylene, plastics, paint, lacquer, or other coatings.

The front guard 306 could be made of any kind of material including but not limited to silicon, rubber, or plastic and take any shape including having waves, a matrix, bumps or other features that interact with the skin and hair in a shaving stroke. The lubrication strip in the cap 308 could be made of any kind of lubricating materials including but not limited to polyethylene oxide, polystyrene, polyethylene glycol, aloe, vitamin E, etc. to deliver lubricating material to the skin and hair after the blades 312 cut the hair in a shaving stroke. More detail on various cap and guard lubrication elements are described below.

Figure 4:
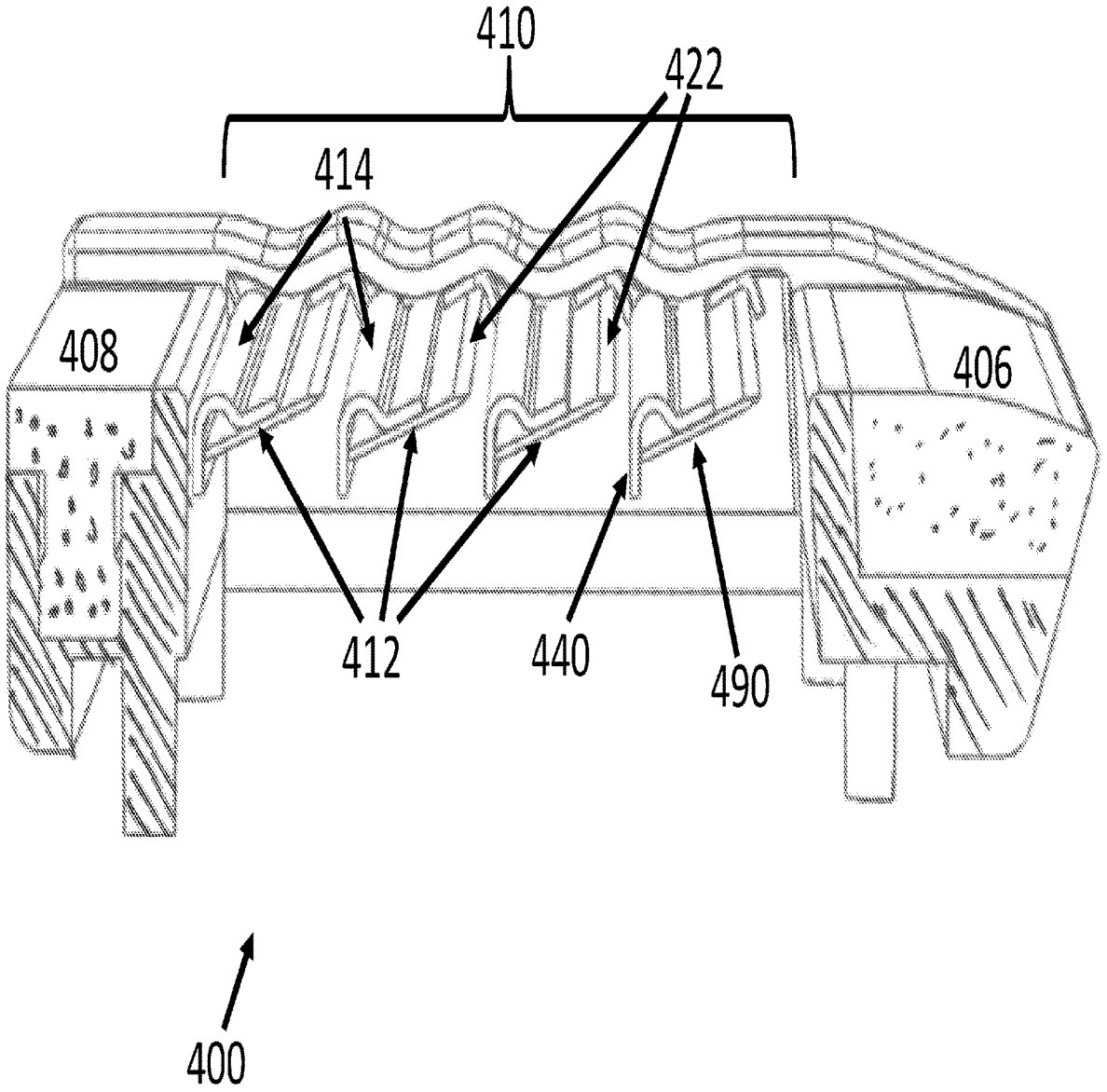
FIG. 4 is another cut away illustration of a razor cartridge according to some embodiments described here.

FIG. 4 shows another example cutaway detail view of a cartridge 400 in a perspective view. This view includes a cut away of the frame assembly 410 and the blades 412 affixed to the bottom of the frame 410 and shown exposing the blade edges 422 through the frame 410 and the intermediate guards 414 behind each blade 412. The guards 414 are shown as integral portions of the unitary frame 410 itself as will be described below. The blade edges 422 are shown spaced apart from each adjacent guards 414 forming a gap to allow wash through of water and shaving material. These guards 414 may have any kind of shape including the humped shape shown in FIG. 4. These intermediate guards 414 may interact with the skin and hair in a shaving stroke. These intermediate guards 414 are arranged between each blade edge 422 just as the front guard 406 is arranged before the first blade 490. These guards 406, 414 prepare the shaving target (e.g. the skin and hair) to be cut by the blades 412, 490.

The guards 414 may be coated with any kind of material to ease friction or aid in standing up hairs for closer cuts. Coatings may include chrome, polytetrafluoroethylene, plastics, paint, lacquer, or other coatings. Thus, the integrated frame system 410 as shown, includes at least as many guards 414 as blades 412 including a front guard 406 as well as a cap 408. The result of using intermediate guards 414 is prepared skin and hair for each blade as opposed to only the front blade 490 by the front guard 406.

The unitary frame 410 also provides strength and support for the blades 412 through its material and also through its shape. The guards 414 and back walls 440 provide a brace for the individual blades 412 as shown. This keeps the blades 412 in place and secures them in a shaving stroke. The frame 410 also supports the blades which may be affixed to the bottom of the intermediate guards 414.

The frame 410 itself may also provide strength for the system as the frame 410 may be made of one unitary material in some embodiments. In some examples, the frame is coated with paint or lubricant or plastic or polytetrafluoroethylene or other coating to ease friction of the skin and hair during a shaving stroke.

Figure 5:
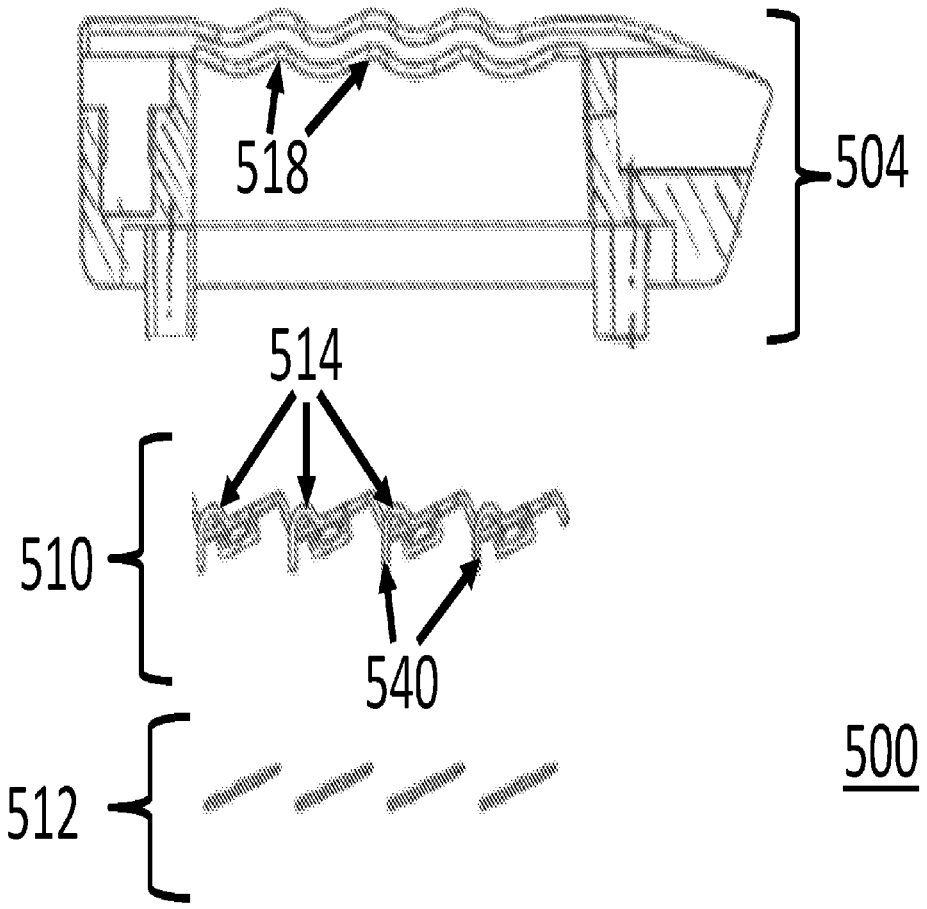
FIG. 5 is an exploded illustration of a razor cartridge according to some embodiments described here.
Figure 5:
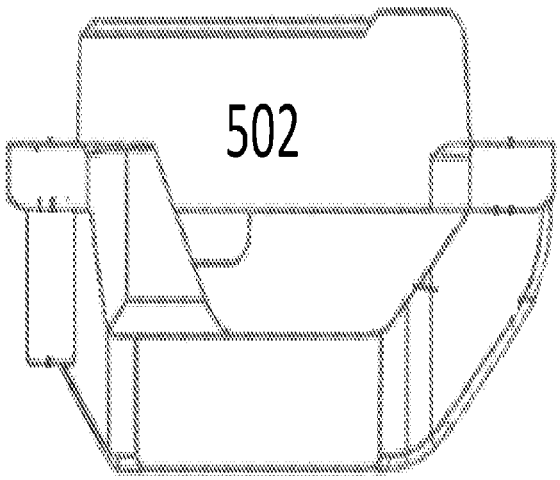

FIG. 5 shows an example exploded cartridge assembly 500 as viewed from the side including a cap 502 and a housing 504. In between the cap 502 and housing 504, the frame 510 and the blades 512 are shown. As shown in FIG. 5, the blades 512 attach to the bottom or underside of the frame 510 and extend through holes that run along the length of the frame 510 as described below. The cap 502 and the housing 504 could be referred to as a top 504 and bottom 502 housing. Such housing units 502, 504 may be configured to snap together by plastic tabs and/or secured by pins and/or snap flanges and/or secured by rivets or staples. Such housing units 502, 504 may be configured to be glued together, welded or otherwise affixed to one another, and sandwich the frame 510 and blades 512 between them. In some embodiments, the top housing unit 504 may include recesses in the side walls which receive and hold the edges of the frame 510 in place. Alternative embodiments include securing the frame 510 and blades 512 into a sing piece housing by bands or snap. The use of a two piece housing is not intended to be limiting and other housing examples could be used as well including but not limited to a single piece housing. In some embodiments, the top housing 504 includes wave elements 518 that follow the overall contours of the frame 510 and blade 512 assembly. Such shapes may aid in a shaving stroke to follow the contours of the intermediary guards 514.

Figure 12A:
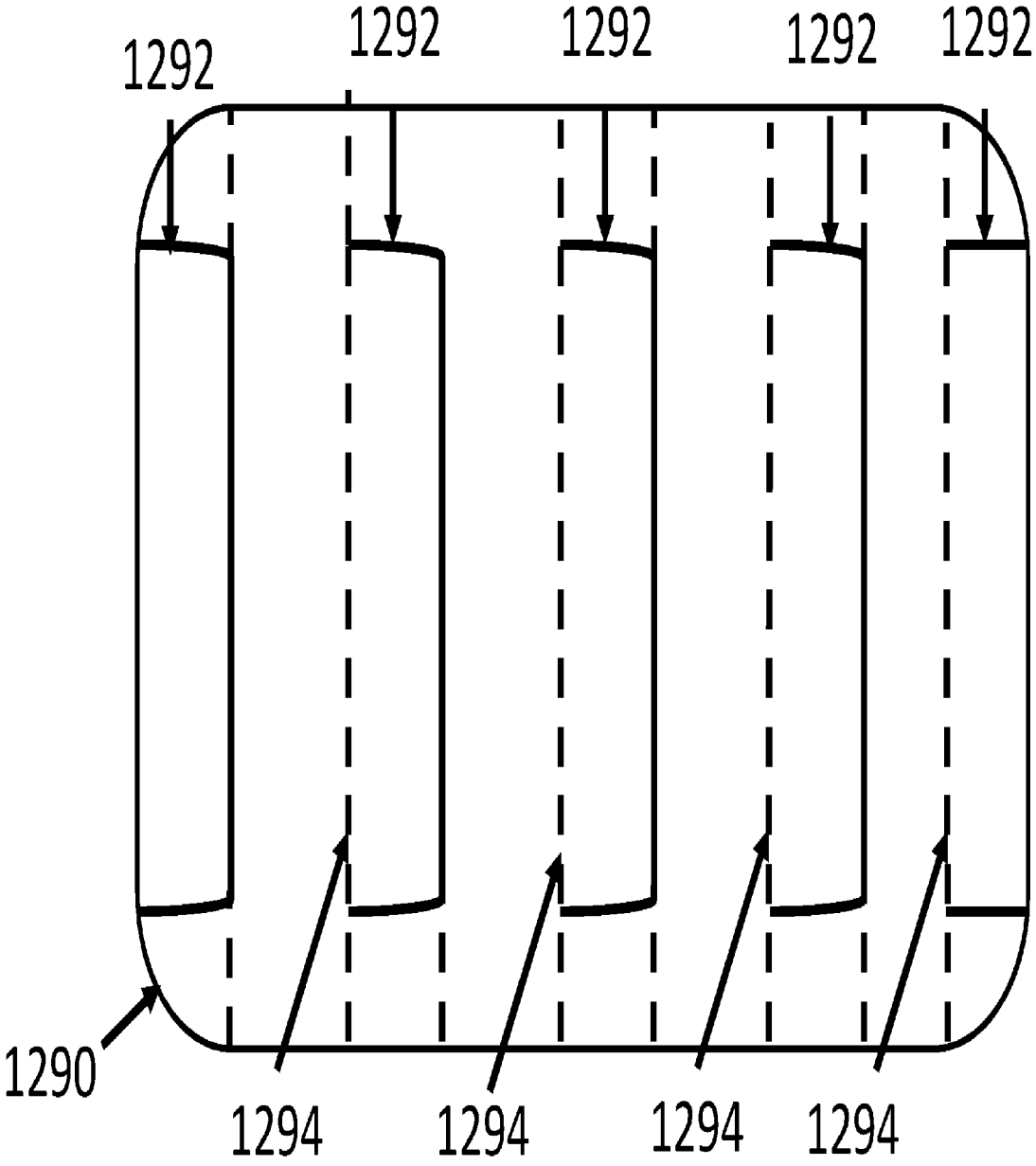
FIG. 12A is a top view of an example frame before cutting and stamping according to some embodiments described here.
Figure 12B:
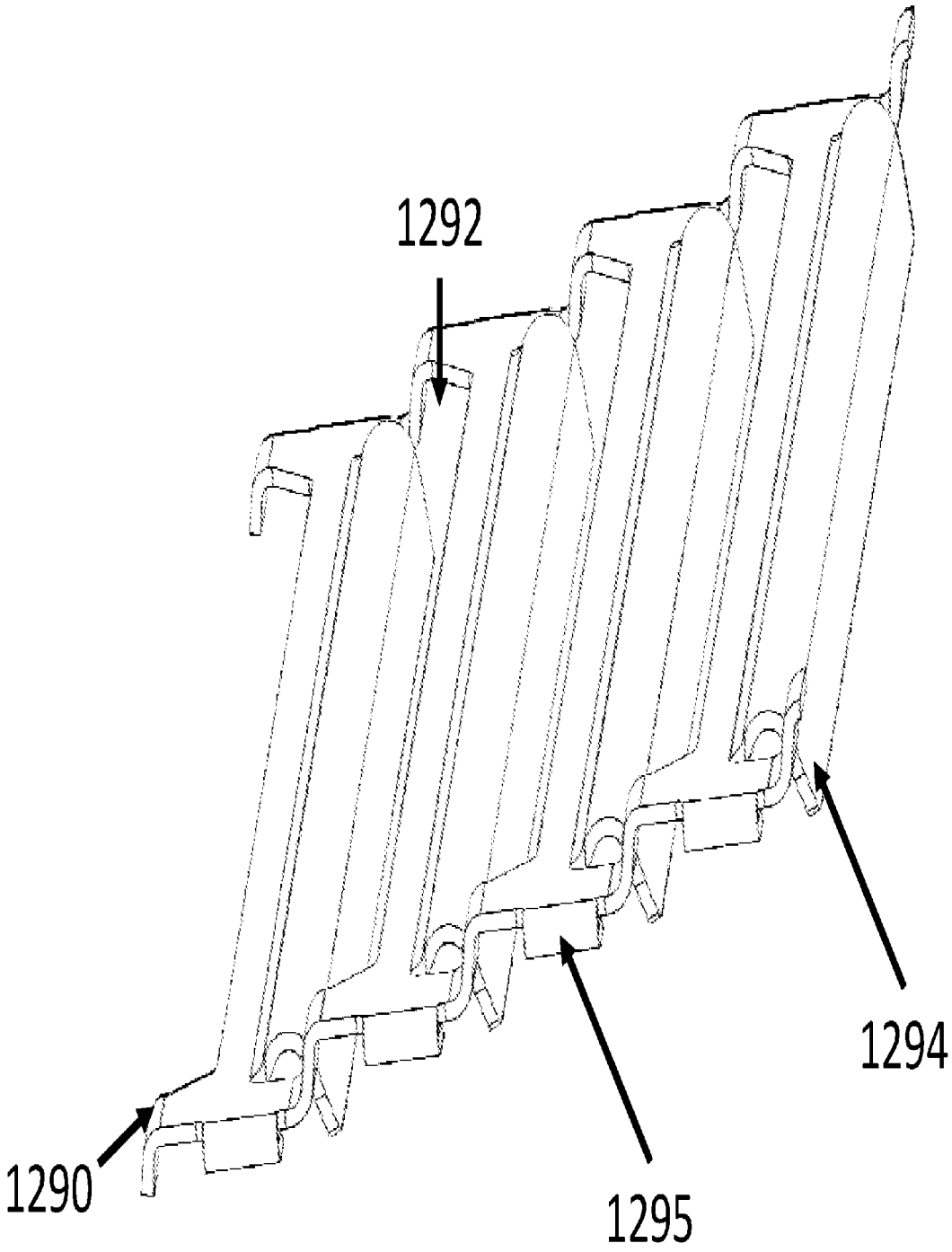
FIG. 12B is a perspective view of an example frame after cutting and stamping according to some embodiments described here.

In some embodiments, the frame 510 is made of one integrated piece of material as described in FIGS. 12A and 12B. In some embodiments the frame 510 could be made of any number of things including but not limited to, metal such as aluminum, steel, stainless steel, iron, bronze, copper, tin or any amalgam of these or other metals. In some embodiments the frame 510 could be made of plastics and/or composites. In some embodiments the frame 510 could be made of carbon fiber and/or ceramic. In embodiments where the frame 510 is made of one piece of metal, the undulations, guards 514, back walls 540 and spaces for the blades 512 to protrude, could all be stamped out of a single sheet as described in FIGS. 12A and 12B. In other words, the frame 510 could start out as a flat sheet of metal and be stamped to form the single unit with guards 514 including back walls 540, portions to affix the blades 512, portions to secure fit into the housing 504 and cap 502, etc. And again, any number of blades 512 could be adhered to the frame 510 according to the various embodiments.

Figure 6:
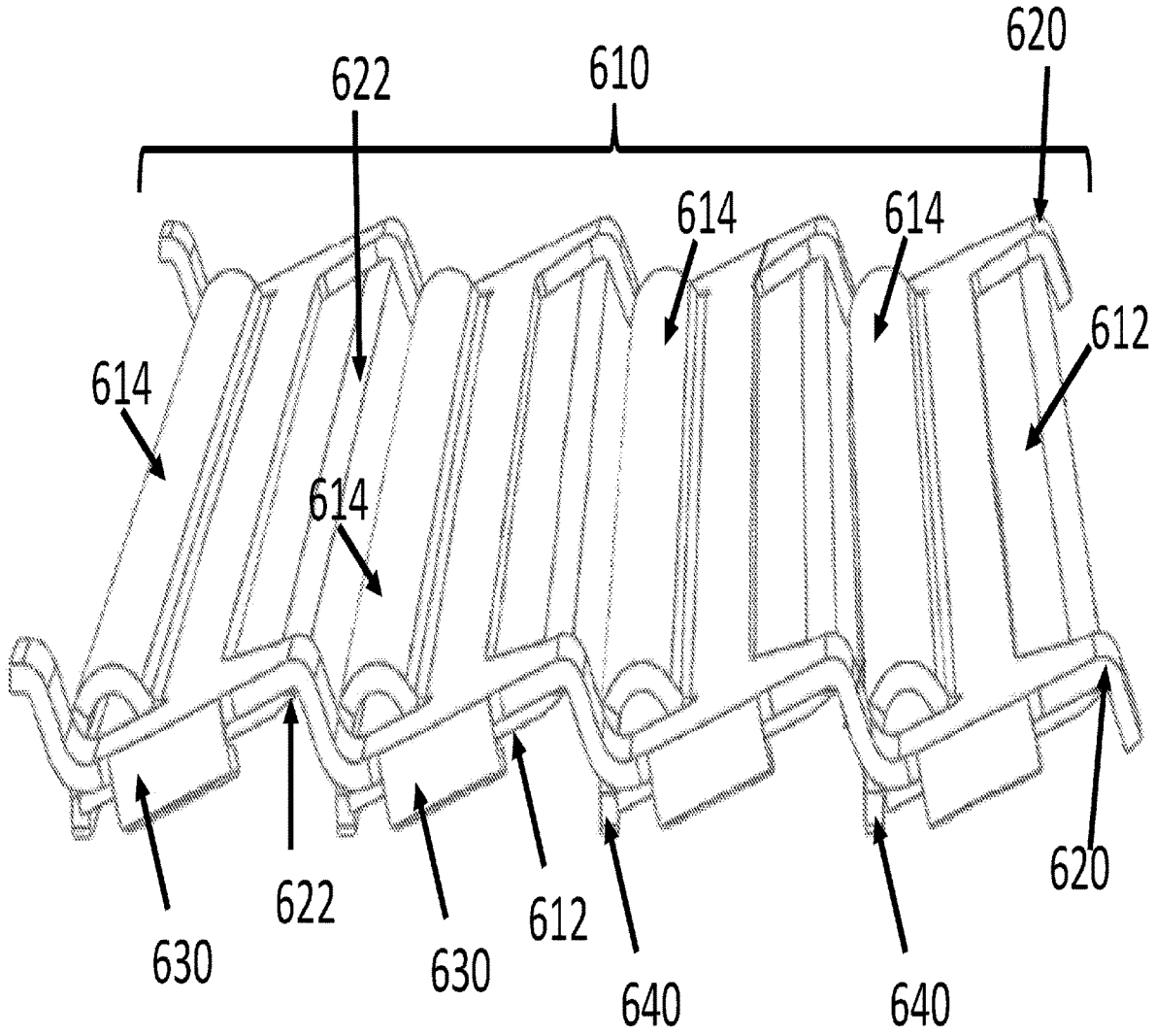
FIG. 6 is another illustration of a frame and blades according to some embodiments described here.

FIG. 6 shows a detail perspective view of just the frame 610 and the blades 612 mounted to the underside of the frame 610. In the example, the guards 614 are shown both forming a gap before the blades 612 and also providing support for the blades 612. The guards 614 may be configured to engage the skin between blades 612 to prepare the skin and hair for the next blade 612 in a shaving stroke. The blade edges 622 are exposed in the gap formed between the blade 612 and the adjacent guard 614. This exposure of the blades is the exposure variable as discussed above, which is the exposure to the skin and hair during a shaving stroke. The frame 610 in FIG. 6 also shows the back walls 640 which form the back walls of the guards 614 and interact with the non-sharpened end of the blades 612 to help hold them in place and support them.

FIG. 6 also shows angled joints or bends 620 on the frame 610. These angled joints or bends 620 form the side walls of the gap between the blade edges 622 and the next respective adjacent guard 614. The angled joints or bends 620 may also help determine the angle of the blade 612 in relation to the overall frame 610, depending on how the angled joints or bends 620 are configured. In some embodiments, the angled joints or bends 620 are made of a flexible material such as spring steel, plastics, rubber, or are jointed to allow flexing of the frame when in use. In some embodiments, the flexing is limited to one direction. More discussion of angled joints or bends and frames appear below and in FIGS. 11 and 12.

In some embodiments, the distance between successive blade edges 622 may be between 1.5 and 1.7 millimeters. In some embodiments, the distance between successive blade edges 622 is between 1.1 and 1.7 millimeters. In some embodiments, the distance between successive blade edges 622 is less than 1 millimeter. In some embodiments, the angle of the angled joints or bends 620 raises the blades 612 to between 16 and 22 degrees from the horizontal. In some examples, the radius of the arc made by the inter blade guards is between 0.1 and 0.4 mm. In some examples, the radius of the arc made by the inter blade guards is between 0.3 and 0.5 mm.

Figure 10:
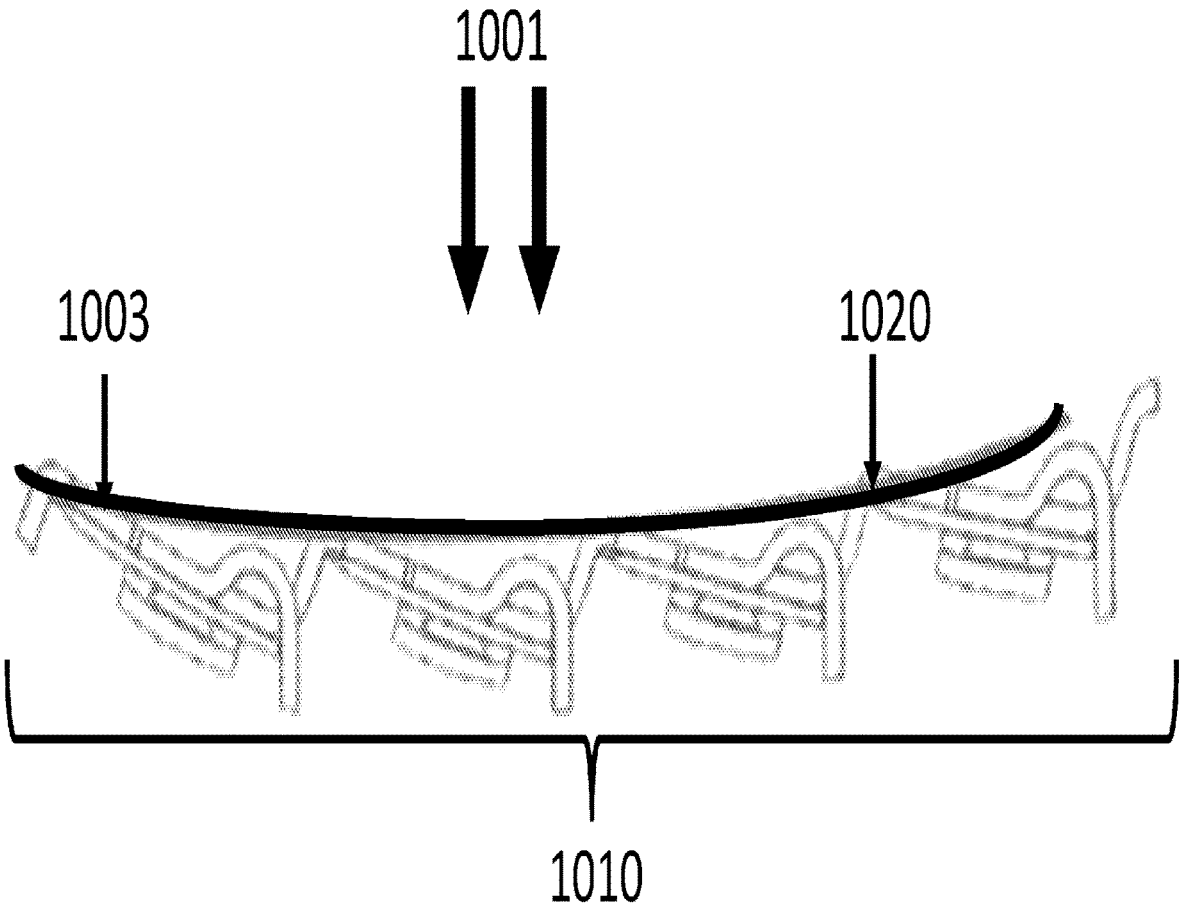
FIG. 10 is another cut away illustration of a frame and blades according to some embodiments described here.
Figure 11:
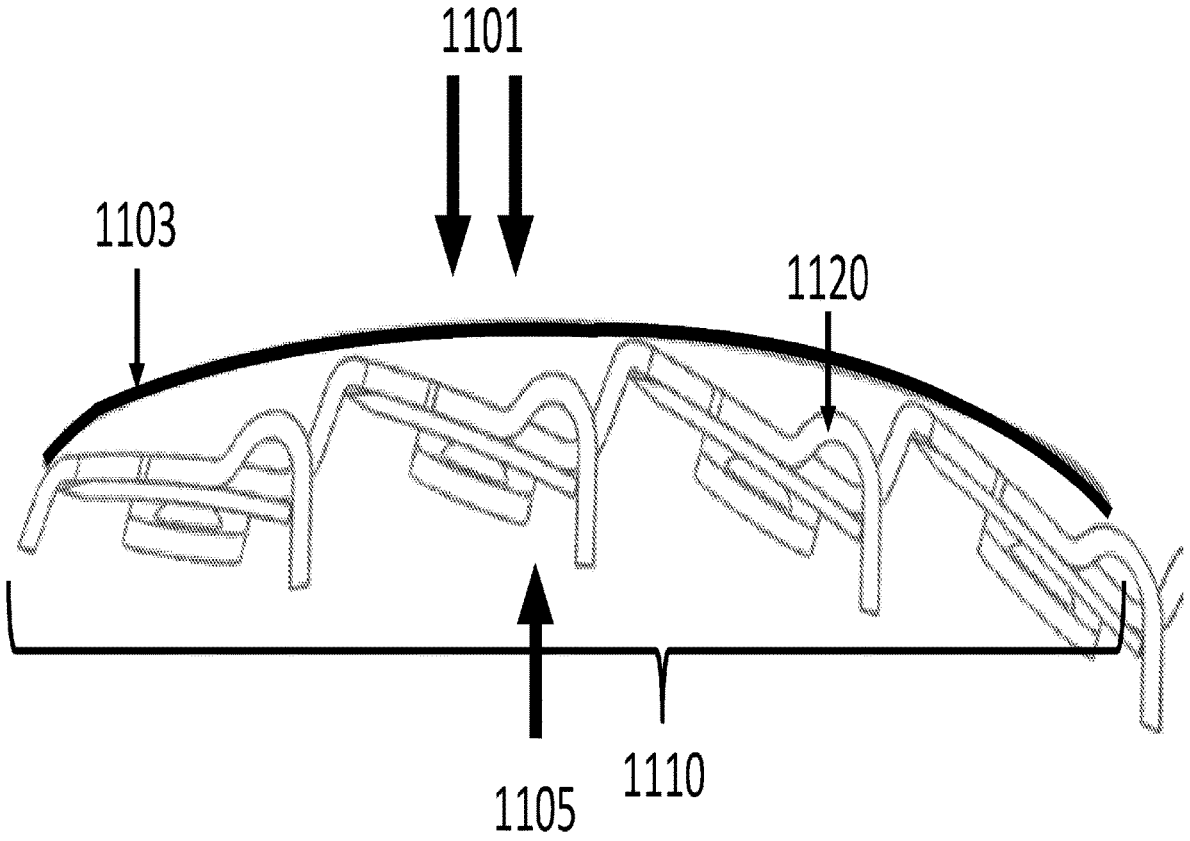
FIG. 11 is another cut away illustration of a frame and blades according to some embodiments described here.

In some embodiments, the exposure of the blades is neutral, in other words, the blade edges 622 do not protrude beyond an imaginary line drawn between the outermost surface of the cap and guard. In some embodiments, the exposure of the blades is all negative. In some embodiments, the exposure of the blades is all positive. In some embodiments, the exposure of the blades is progressive, ranging from positive to negative or regressive, negative to positive. In some examples, as shown in FIGS. 10 and 11, the exposure between blades is arranged on a curved arc. In some embodiments, the width of each blade 612 is between 1.2 and 2.2 millimeters.

The example of FIG. 6 also shows connecting portions 630 or tabs on the frame 610. These connecting portions 630 or tabs may be located on the edges of the frame 610 and interact with the cap and housing (not shown) in order to secure the frame into the cartridge by snapping, welding, gluing or other ways.

Lubrication Examples

Referring again to FIG. 1, the cap 108 and/or guard 106 may have lubrication properties or features in them. In some examples, the cap 108 has a lubrication strip embedded into it or attached to it. In some examples, the guard 106 may have a lubrication strip embedded into it or attached to it. In some examples, the cap 108 and/or guard 106 itself is made of a lubricating material instead of attaching one to it. For example, the cap 108 and/or guard 106 may be made entirely or partially of a solid bar of shaving soap. Such soap could have lubricating properties when wetted and/or other properties such as antibacterial, fragrant, color, texture, etc. In some embodiments, the cap 108 and/or guard 106 may be replaceable. Such replaceable parts could allow a user or manufacturer to attach a cap 108 and/or guard 106 with some properties. Replaceable cap 108 and/or guards 106 may allow for refreshing the soap bar after some number of uses, or replacement to gain features of another kind of soap bar. Attachment of such a replaceable cap 108 and/or guards 106 may include any kind of clamp, slide, snap, wedge, hook, lever, magnet, or other kind of mechanical attachment.

FIG. 3 shows a cut away view of the cartridge with the cap 308 and guard 306. As can be seen in the cut away view, the cap 308 and/or guard 306 could be made of any kind of lubricating material including but not limited to shaving soap as discussed above. The shaving soap could be affixed to the cartridge body by any kind of friction fit, slide or other way. For example, the soap bar could have a T shape construction that allows it to slide into the cartridge head and remain in place with friction during shave operation.

Figure 7:
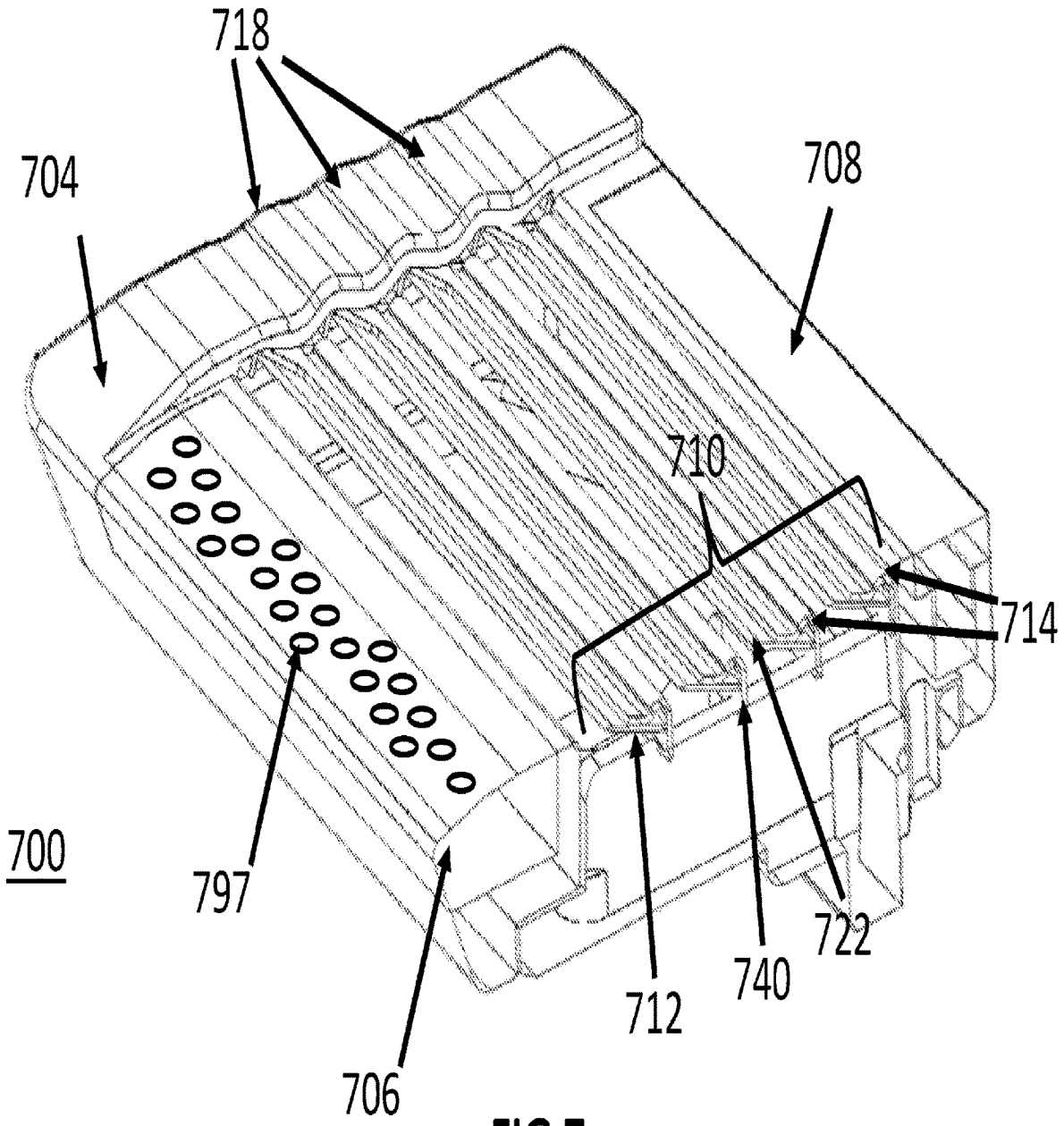
FIG. 7 is a cut away illustration of the cartridge according to some embodiments described here.

FIG. 7 shows a cut away perspective view of an example cartridge 700 with the frame 710 and blades 712 attached. The frame 710 is shown attached to the cartridge housing 704 with the blades 712 affixed to the underside of the frame 710 and the back walls 740. The blade edges 722 are shown exposed between guards 714. The front guard 706 and the cap 708 with optional lubrication properties are also depicted.

The example cartridge 700 also depicts a particular cartridge wave shape 718 in the housing 704 side walls. In this example, the cartridge shape 718 follows the shape of the intermediary guards 714 in the frame 710. Various embodiments may be made including cartridges which do not follow the shape of the guards 714 of the frame 710.

FIG. 7 also shows an embodiment with lubrication on the guard 706 in the form of openings or wells 797 formed in the guard 706 surface. Such wells 797 may be loaded with shaving soaps, gels, lubricants, etc., as described above. The example wells 797 may be any depth and retain the soap or other material until it becomes wet during shaving, and then the material may be released or liquefy, depending on the properties of the material. The example of circular wells 797 is not intended to be limiting. Any pattern of any kind of shape could be used, including but not limited to circles, squares, triangles, hexagons, waves, ovals, trapezoids, grid, spiral, etc. In some examples, the guard 706 could be made of a polymer sponge or foam with open or closed cells that is able to absorb the lubrication and/or water during a shave. In some examples, these lubrication features may be found in the cap 708 as well as, or alternatively as in the guard 706.

In some examples, the front guard 706 includes capillary tubes, arranged in the guard itself. These capillary tubes may be filled or partially filled with lubrication soap, or may interact with a lubrication reservoir in the guard itself. In use, the capillary tubes may release soap when wet and when contacted with skin and hair. Such capillary tubes may be formed from any kind of fibers arranged into tube like shapes and draw lubrication soaps from an underside of the front guard to a surface of the front guard during use. In some examples, the cap 708 may have similar or different lubrication than the guard 706, either or both may include lubrication aspects. In some example embodiments, the intermediary guards 714 may be coated with polytetrafluoroethylene (PTFE), or other friction reducing coating, and/or may be coated in lubricating soaps.

Figure 8:
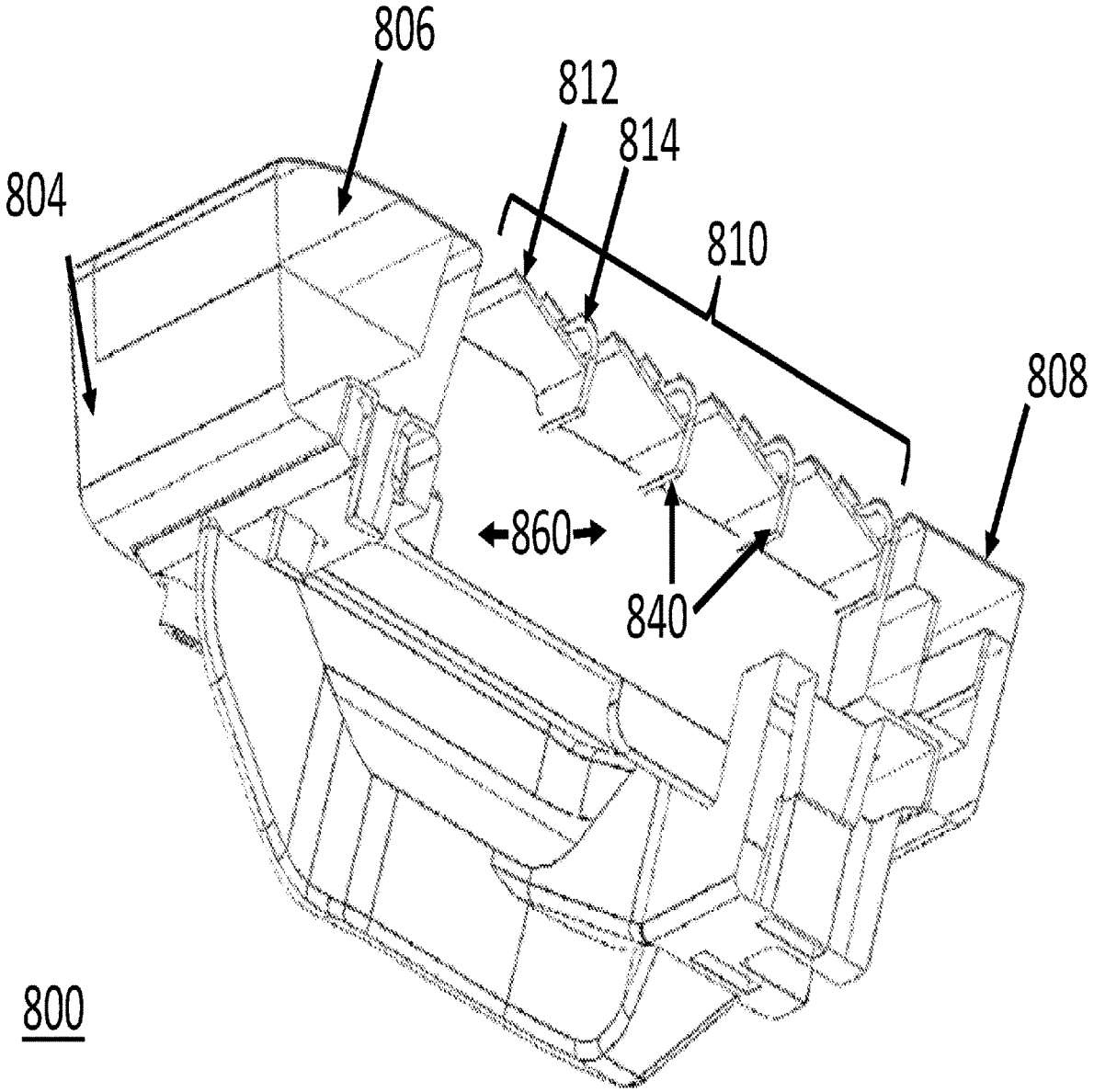
FIG. 8 is another cut away illustration of the cartridge according to some embodiments described here.

FIG. 8 shows another cut away perspective view of an example cartridge from the underside. The frame 810 is shown attached to the cartridge housing 804. In this view, it can be seen that the blades 812 are affixed to the underside of the frame 810 supported by the back walls 840 which include the intermediate guards 814. The front guard 806 and the lubrication strip 808 are also depicted.

In some embodiments, cartridge walls 860 are placed in the cartridge to help support the frame 810. In some embodiments, these cartridge walls 860 run perpendicular to the direction of the blades 812 and guards 814 and are integrated into the cartridge housing 804. In some embodiments, the back walls 840 interact with and are supported by the cartridge walls 860. In this way, the frame 810 is braced at various places along the length of the cartridge 800. The number of cartridge walls 860 could vary from one, two, three, four, five, six, or even more, spaced evenly or unevenly over the length of the cartridge 800.

These cartridge walls 860 could be made of any material including plastic, metal or other material. In some embodiments the material of the walls 860 may match the material of the cartridge housing 804. In some embodiments, the material of the cartridge walls 860 may match the material of the frame 810.

It should be noted that the lubrication examples could be used in conjunction with and in addition to any of the other embodiments or features described in this disclosure. Therefore, a system could be built using any combination of the features described here.

Frame Example Details

Figure 9:
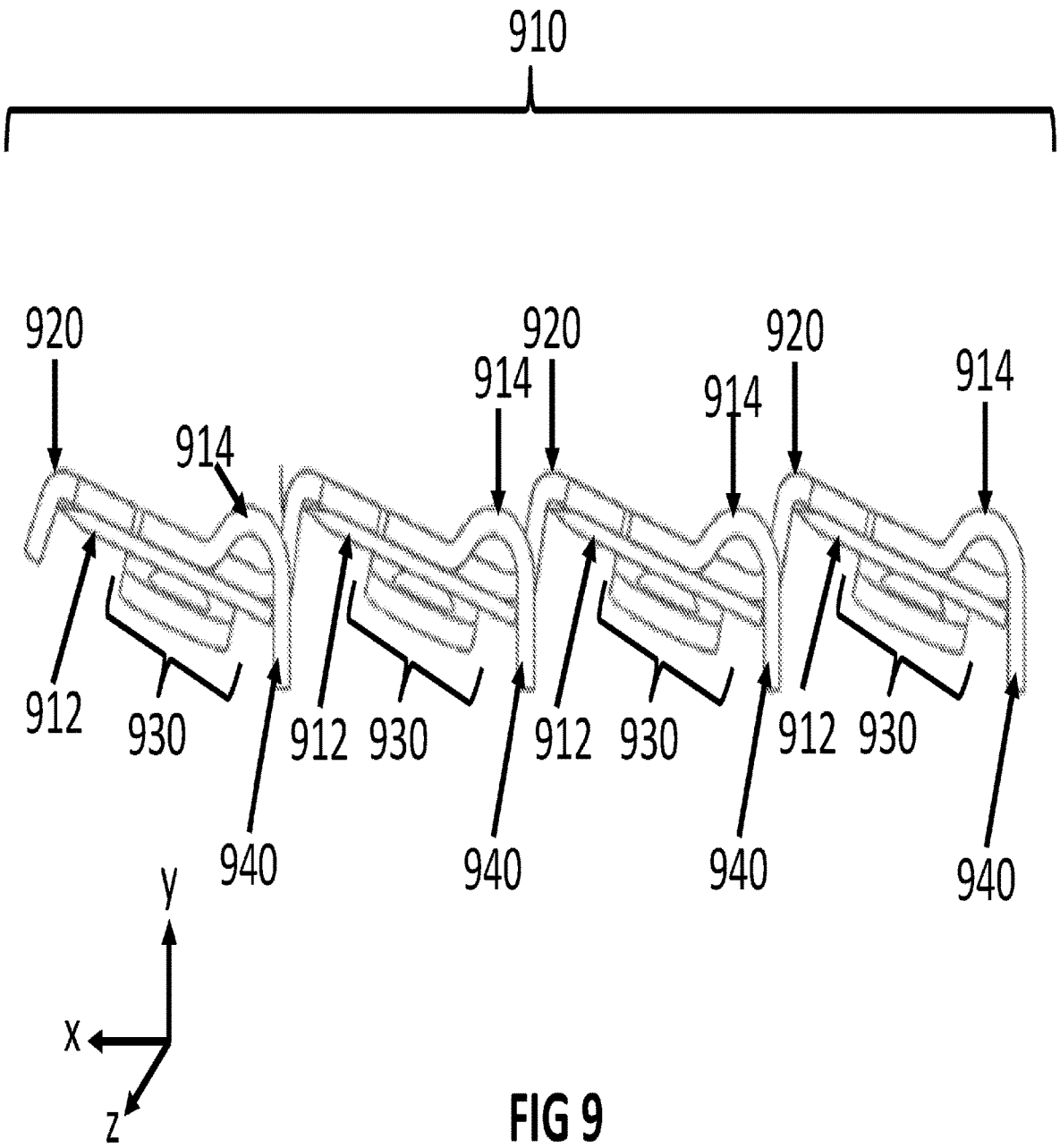
FIG. 9 is another cut away illustration of a frame and blades according to some embodiments described here.

FIG. 9 shows a cut-away side view of an example frame 910 and blades 912 attached to it. For purposes of discussion, x, y, and z coordinates are depicted in the figure with the overall frame 910 is shown generally in the x-z plane.

The blades 912 are shown affixed to the underside of the frame 910 and interacting with, and supported by, the back walls 940. In the example frame, the back walls 940 are a continuation of the guards 914 and thereby incorporated into one unit. The angled joints or bends 920 in the frame 910 are shown in detail and the angles of these joints or bends 920 may determine the overall posture of the adjacent blade 912 in relation to the frame 910 within which it is mounted, and thereby the overall posture of the frame 910 as a whole. As discussed above, the blades 912 may have the same angle or differing angles in comparison to one another, as they are affixed in the frame 910. Progressively or regressively angled blades 912 may interact with the skin and hair differently in a shaving stroke than blades 912 angled in the same way throughout the frame 910, thereby many different examples of blade 912 angles, gaps between blades 912, posture based on the joints or bends 920 may be created using this frame 910 concept.

FIG. 10 shows an example side cut away view of a blade frame 1010 according to some embodiments that have a concave curvature 1003 to it, when viewed from the perspective of the shaving target 1001. As discussed above, in embodiments where the angled joints or bends 1020 are configured with a wide angle, the overall effect on the frame 1010 as a whole is to curve, in this example in a concave direction 1003. Such a curve may be held in place by a rigid frame 1010 and the cartridge housing (not pictured), or combination of these. In some example embodiments, the frame 1010 and/or angled joints or bends 1020 may flex when force is applied to them. In some examples, the frame 1010 may be made of a flexible material throughout, or include joints or bends 1020 which are made of flexible material. In such examples, the frame 1010 may have a flat appearance when not under pressure, but flex into a concave shape 1003 when force is applied to the frame 1010, as in a shaving stroke. In examples with a concave frame 1010 arrangement, the blade angles and gaps and guards may be differently configured than in embodiments where the frame is relatively flat or convex as described in FIG. 11.

FIG. 11 shows an example side cut away view of a blade frame 1110 according to some embodiments that have a convex curvature 1103 to it, when viewed from the perspective of the shaving target 1101. As discussed above, in embodiments where the angled joints or bends 1120 are configured with a narrower angle or are bent a particular way, the overall effect on the frame 1110 as a whole is to curve, in this example in a convex direction 1103. Such a curve may be held in place by a rigid frame 1110 and/or the cartridge housing (not pictured). In some example embodiments, the frame 1110 and/or angled joints or bends 1120 may flex when force is applied to them. In such examples, the frame 1110 may have a flat appearance when not under pressure, but flex into a convex shape 1103 when force is applied to the back or underside of the frame 1110 by some pushing mechanism 1105 such as a wedge or other structure.

In examples with a convex frame 1110 arrangement, the blade angles and gaps and guards may be differently configured than in embodiments where the frame is relatively flat or concave as described in FIG. 10.

Unitary Frame Example Details

As discussed above, in some embodiments as detailed in FIGS. 9, 10 and 11, the unitary frame is a made from one piece of flat material that is cut and bent into a frame. FIG. 12A shows an example simplistic diagram of a flat piece of material which can be stamped into a frame, with solid lines 1292 drawn where cuts may be made and dashed lines 1294 where bends may be made. The shapes formed from the cuts 1292 can be bent so as to form the back walls of the frame to support the blades which may be mounted on the frame as well as the inter-blade guards. It should be noted that the actual cuts and bends in the unitary piece of material may be more nuanced and detailed than what is shown in FIG. 12, including the addition of tabs for affixing the completed frame into the cartridge head, etc.

To manufacture such a frame using one unitary flat piece of material, the cuts and bends may be made all in one step using any combination of a stamp, laser cutter, press, or other manufacturing device or process. Alternatively or additionally, injection molding may be used to create a unitary frame as well. As can be seen, the entire frame is therefore made of one piece of material. Such material may be any number of things including but not limited to metals such as steel, aluminum, brass, copper, tin, an alloy or combination of these or other metals. The frame may be made molded or stamped using plastics, resins, ceramics, or other materials as well. The thickness of the material used to cut and bend the frame could be any amount, such as but not limited to, 1 mm thick, 0.75 mm thick, or 1.2 mm thick. In some embodiments, the flat piece of material may have different thicknesses in different parts. For example, the middle where the blades attach may be thinner than the edges which include the bent elbow portions.

FIG. 12B shows a perspective view of the fully cut and bent, or molded frame 1290. In the cut and bent embodiments, the cuts 1292 form the shapes which are bent 1294 to form the back walls of the blade supports. As can be seen from the perspective view, in some embodiments the entire frame 1290 is also bent into a stair step manner to allow for the blades (when affixed, not pictured) to tilt upwardly for exposure, and not lay flat. In some embodiments, other features such as tabs or bends 1295 may be included in the unitary frame 1290 to be used to secure the frame into or on the cartridge head. Again, these tabs 1295 may be stamped from the unitary frame as disclosed above.

It should be noted that the unitary frame could be used in conjunction with and in addition to any of the other embodiments or features described in this disclosure. Therefore, a system could be built using any combination of the features described here.

Canted Blade Examples

In some example embodiments, the blades in the razor cartridge are not aligned 90 degrees to the edge of the frame of the cartridge, instead, they are arranged in a slightly canted manner. If the blades are slightly canted in the cartridge head itself, a normal shaving pull or stroke will place the blades at a slightly angled attack, creating a shearing force to go with the normal perpendicular cutting force, and thus may aid shaving closeness and comfort.

Figure 13A:
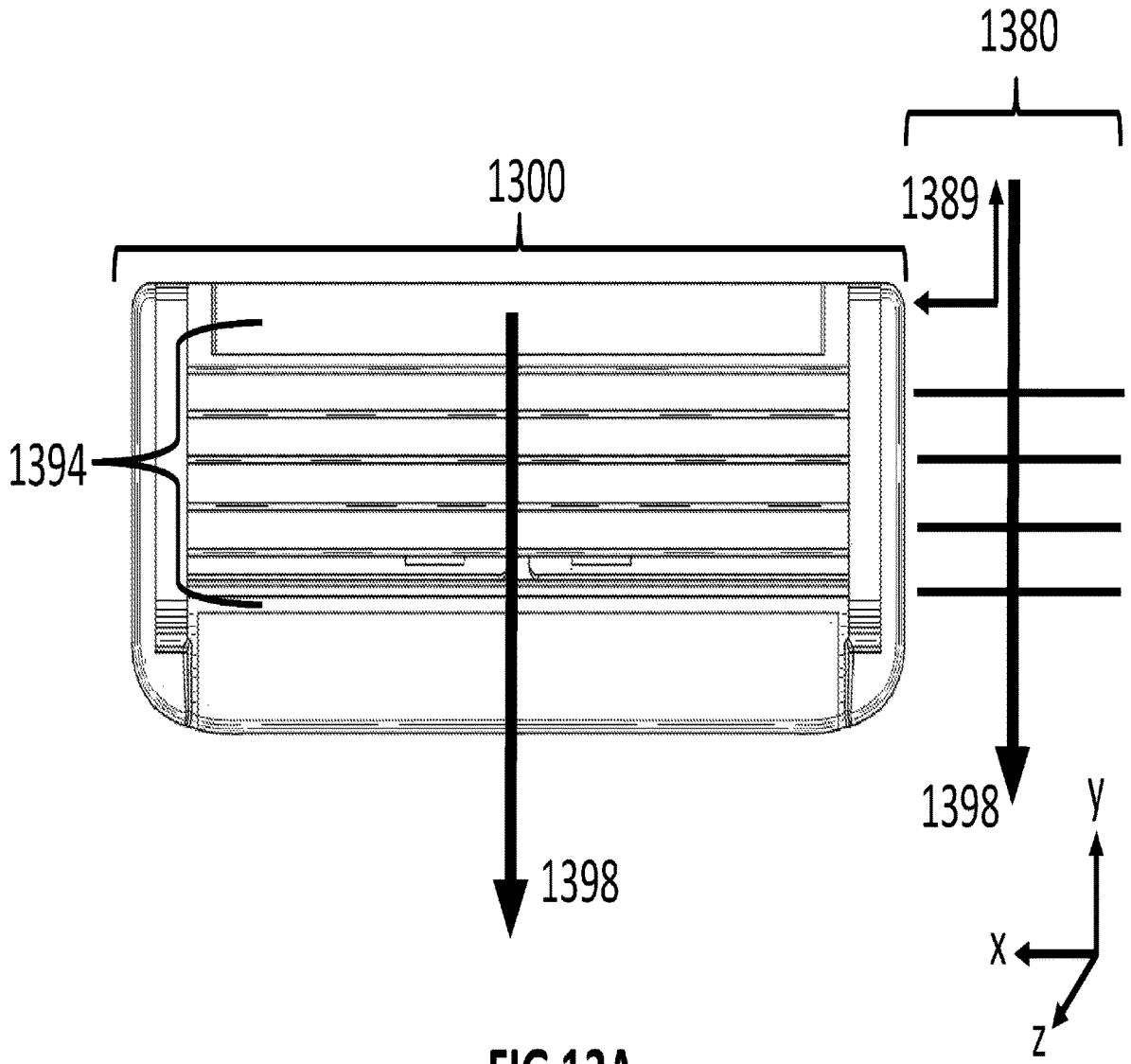
FIG. 13A is a side-by-side diagram showing a cartridge and corresponding blade arrangement according to some embodiments described here.

In order to demonstrate embodiments of such examples, it should be noted that FIGS. 13A, B and C show exaggerated blade angles in order to accentuate what the actual angles may be in the system itself. The actual angles which may be used to cant blades in a cartridge head may be imperceptible to human sight without aid, but could be on the order of 1 or 2 degrees from the perpendicular. In some example embodiments, blades maybe canted as described here between 1 and 3 degrees from perpendicular. In some example embodiments, blades may be canted 5 or fewer degrees from perpendicular. In some examples, the blades may be canted between 3 and 9 degrees, or could be larger such as 12 to 14 degrees. Any amount of slight canting may allow for the shearing force to be applied by the blades to the target hair. The examples here are not intended to be limiting.

For example, FIG. 13A shows an example cartridge 1300 next to an abstraction of the arrangement of the blades 1380, in this example the blades are arranged in parallel and perpendicular 1389 to the edge of the cartridge as in a typical arrangement. Thus, FIG. 13A shows the blades 1394 aligned parallel to the x axis and aligned generally perpendicular to the direction of the intended shaving stroke 1398. This is a typical embodiment without canted blades.

Figure 13B:
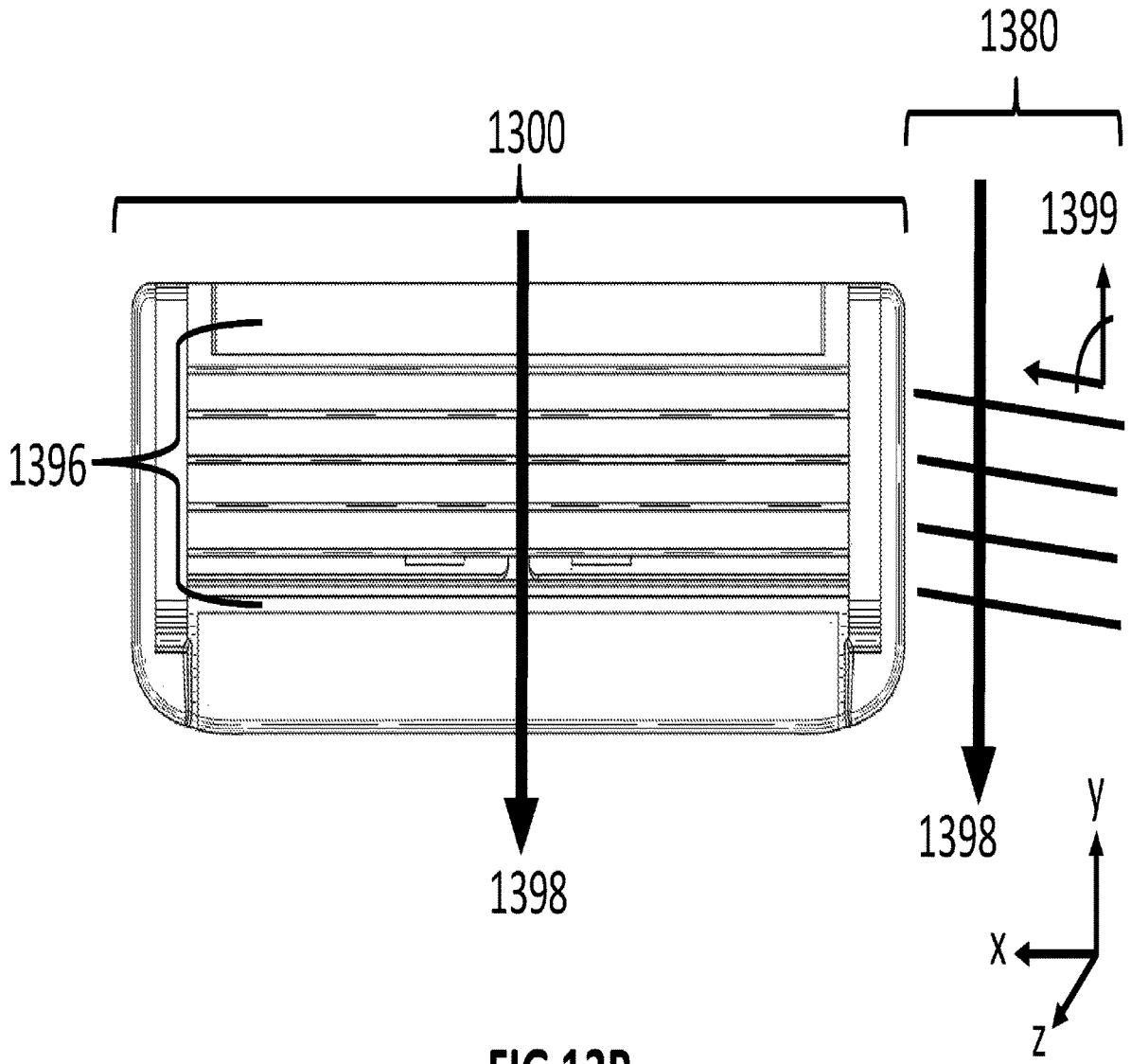
FIG. 13B is another side-by-side diagram showing a cartridge and corresponding canted blade arrangement according to some embodiments described here.

FIG. 13B shows an example cartridge 1300 next to an abstraction of the arrangement of the blades 1380, and how they are arranged parallel to one another, but in this example canted slightly 1399 off of the x axis, and thus, not completely perpendicular to the direction of the shaving stroke 1398 or the sides of the cartridge itself 1300. In such an arrangement, because a user will pull the cartridge head in a shaving stroke 1398 that is based on the cartridge head itself 1300 and not the angle the blades are arranged 1380, a shearing force may be imparted on the target hair by the blades 1396 instead of or, in addition to, a head-on cutting force. This combination of shearing and cutting may make for a smoother, more comfortable shave with less irritation and/or tugging.

Figure 13C:
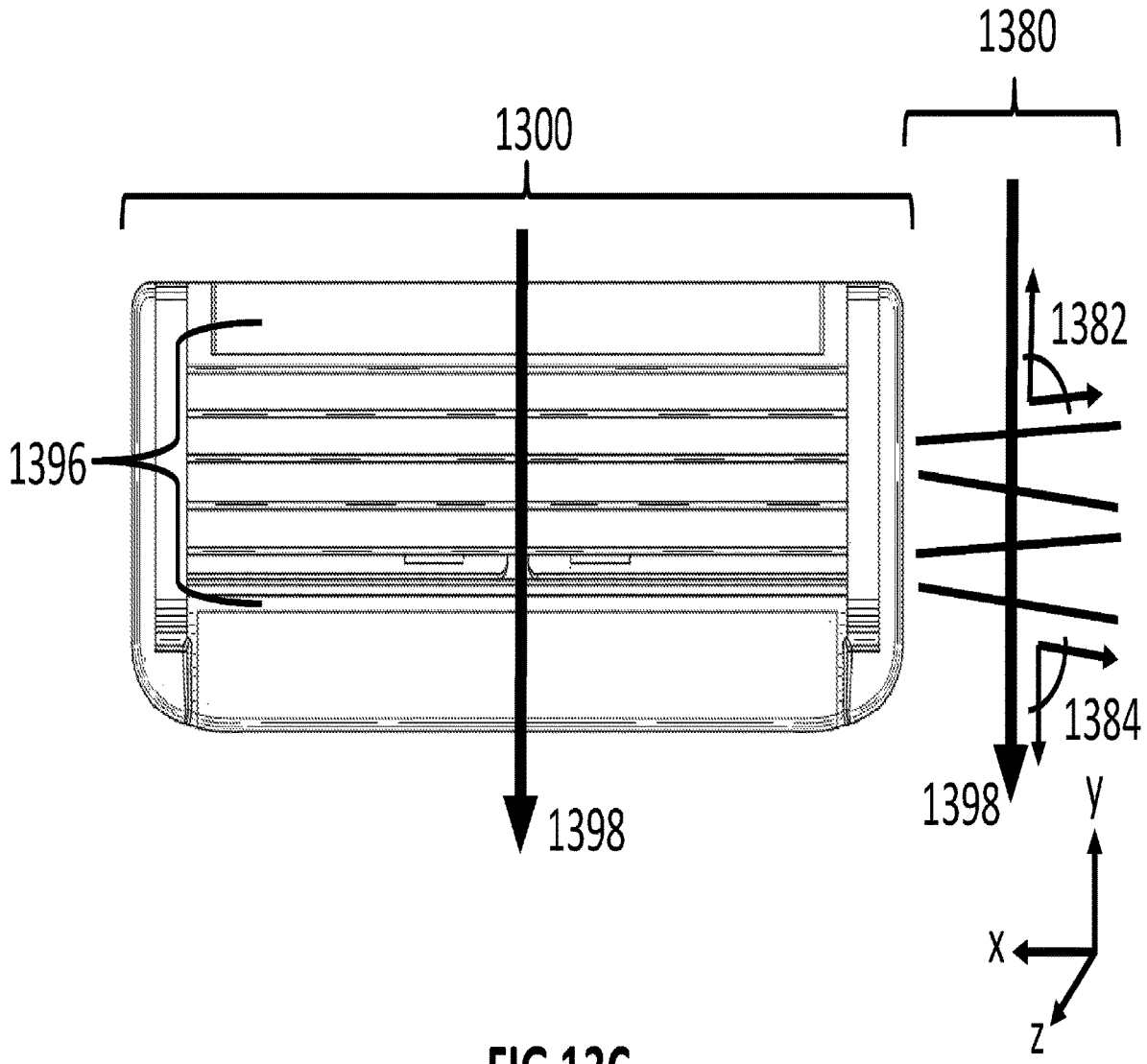
FIG. 13C is another side-by-side diagram showing a cartridge and corresponding canted blade arrangement according to some embodiments described here.

FIG. 13C shows an example cartridge 1300 next to an abstraction of the arrangement of the blades 1380, and how the blades are not arranged parallel to one another, but alternating, 1382, 1384. In such examples, the canted blades may be arranged in different canted alternating directions 1382, 1384 with one group of blades parallel to each other but another group of blades parallel to each other, but not to the first group of blades. The number of parallel groups is not limited to two and could be three or four. In some example embodiments, instead of groups of blades in parallel sets, there may be singular blades that are not in parallel with another group. In any of these embodiments, the differing canted blades would allow for different shearing forces to be exerted by each of the blades. In such arrangements, rather than all the blades canted the same way, they would each be different 1382, 1384 or grouped in different canted arrangements. In some embodiments, a combination of perpendicular and canted blades may be used to impart both cutting and shearing forces on the target hair.

It should be noted that the canted blade embodiments could be used in conjunction with and in addition to any of the other embodiments or features described in this disclosure. Therefore, a system could be built using any combination of the features described here.

Conclusion

The foregoing description, for purpose of explanation, has been described with reference to specific embodiments. However, the illustrative discussions above are not intended to be exhaustive or to limit the embodiments to the precise forms disclosed. Many modifications and variations are possible in view of the above teachings. The embodiments were chosen and described in order to best explain the principles of the embodiments and its practical applications, to thereby enable others skilled in the art to best utilize the various embodiments with various modifications as are suited to the particular use contemplated.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Although some presently preferred implementations of the embodiments have been specifically described herein, it will be apparent to those skilled in the art to which the embodiments pertains that variations and modifications of the various implementations shown and described herein may be made without departing from the spirit and scope of the embodiments. Accordingly, it is intended that the embodiments be limited only to the extent required by the applicable rules of law.

What is claimed is:

1. A method of making a razor cartridge, comprising:

stamping a flat stainless steel piece to form a unitary frame having a length, a width, a top and a bottom, thereby forming at least three elongated parallel flaps that extend partially, but not completely along the length of the unitary frame-, the flaps including at least three bent back walls and at least three elongated holes in the unitary frame, and at least three humps parallel to the at least three elongated holes and partially, but not completely along the length of the unitary frame, wherein the at least three humps are respectively arranged adjacent to each of the at least three elongated holes, wherein the flat stainless steel piece is between 1.2 mm thick and 0.6 mm thick before stamping;

welding at least three flat stainless steel blades to the unitary frame so a first edge of each of the at least three flat stainless steel blades protrudes through one of the at least three elongated holes and a second edge of the flat stainless steel blades is adjacent to the corresponding back wall of the at least three bent back walls, wherein the unitary frame includes at least three bends along the width of the unitary frame forming stair step shape;

mounting the unitary frame and welded flat stainless steel blades to a cartridge housing including a cap and a guard, wherein the first edge of each of the at least three blades extends respectively into each of the at least three elongated holes in the unitary frame when welded to the lengthwise portions of the underside of the unitary frame between angles of 12 and 30 degrees from a plane defined from highest points on the top of the unitary frame.

2. The method of claim 1 wherein a distance between each successive first edge of the at least three blades is between 1.1 mm and 1.7 mm when welded into the unitary frame.

3. The method of claim 1 wherein the stamping forms at least four edge tabs bent into the width sides of the unitary frame.

4. The method of claim 1 wherein the second edge of the flat stainless steel blades each touch the corresponding back wall.

5. The method of claim 1 wherein the unitary frame has a convex curvature.

6. The method of claim 5 wherein the unitary frame is configured to flex when pressure is applied to it.

7. The method of claim 1 wherein the flat stainless steel blades are all welded to the unitary frame in a canted configuration between 3 and 9 degrees from parallel.

* * * * *